US012800251B2

(12) United States Patent
Painter

(10) Patent No.: US 12,800,251 B2
(45) Date of Patent: Nov. 17, 2026

(54) FIREARM BARREL FOR LEVER ACTION FIREARM

(71) Applicant: Blackstone Firearms, LLC, Delavan, WI (US)

(72) Inventor: Aaron E Painter, Delavan, WI (US)

(73) Assignee: Blackstone Firearms, LLC, Delevan, WI (US)

( * ) Notice: Subject to any disclaimer, the term of this patent is extended or adjusted under 35 U.S.C. 154(b) by 0 days.

(21) Appl. No.: 19/183,363

(22) Filed: Apr. 18, 2025

(65) Prior Publication Data

US 2026/0160514 A1 Jun. 11, 2026

Related U.S. Application Data

(63) Continuation-in-part of application No. 18/583,620, filed on Feb. 21, 2024, now Pat. No. 12,467,707.

(51) Int. Cl.
*F41A 21/02* (2006.01)

(52) U.S. Cl.
CPC ..... *F41A 21/02* (2013.01)

(58) Field of Classification Search
CPC ..... F41A 21/04
USPC ..... 42/76.02
See application file for complete search history.

(56) References Cited

U.S. PATENT DOCUMENTS 855,439 A 6/1907 Adrianson
2,249,899 A 7/1941 Hogg
2,467,372 A 4/1949 DePermentier
2,516,926 A 8/1950 Simpson
2,655,837 A 10/1953 Johnson
2,935,912 A 5/1960 Hartley
2,965,994 A 12/1960 Sullivan
3,118,243 A 1/1964 Manshel
3,367,054 A 2/1968 Loffler
3,486,411 A 12/1969 Lichtenstern
3,742,640 A 7/1973 Thomas
3,805,434 A 4/1974 Sudano
3,872,771 A 3/1975 Pierre et al.
4,058,050 A 11/1977 Brouthers
4,211,146 A 7/1980 Bradley
4,304,061 A 12/1981 Brouthers
4,638,713 A 1/1987 Milne
4,646,615 A 3/1987 Gladstone et al.
4,685,236 A 8/1987 May
(Continued)

FOREIGN PATENT DOCUMENTS

GB 2350881 12/2000
WO WO97/22843 6/1997
WO WO1997022843 6/1997

OTHER PUBLICATIONS

Ruger, Ruger 10/22® Takedown Lite, https://www.ruger.com/news/2016-05-20a.html; 2016, accessed Jun. 8, 2026 (2 pgs).
(Continued)

*Primary Examiner* — Samir Abdosh
(74) *Attorney, Agent, or Firm* — Ryan Kromholz & Manion, S.C.

(57) ABSTRACT

A firearm barrel for a lever action firearm. The firearm barrel has an inner barrel, and outer barrel, and a muzzle keeper. The firearm barrel may also include a gas bushing. The muzzle keeper is threaded onto said inner barrel to retain said outer barrel in place to fully tension said firearm barrel.

16 Claims, 30 Drawing Sheets

(56) References Cited

U.S. PATENT DOCUMENTS

| | | | | |
|---|---|---|---|---|
| 4,762,048 | A | 8/1988 | Higashi | |
| 4,769,938 | A | 9/1988 | Chesnut | |
| 4,774,872 | A | 10/1988 | Creedon | |
| 4,833,810 | A | 5/1989 | Domian | |
| 4,841,836 | A | 6/1989 | Bundy | |
| 4,911,060 | A | 3/1990 | Greenspan | |
| 4,982,648 | A | 1/1991 | Bol | |
| 5,125,179 | A | 6/1992 | Campbell | |
| 5,160,802 | A | 11/1992 | Moscrip | |
| 5,212,328 | A | 5/1993 | Petrovich | |
| 5,214,234 | A | 5/1993 | Divecha | |
| 5,255,615 | A | 10/1993 | Magaldi | |
| 5,341,719 | A | 8/1994 | Bullis | |
| 5,355,765 | A | 10/1994 | Rogers | |
| 5,581,928 | A | 12/1996 | Krumm | |
| 5,600,912 | A * | 2/1997 | Smith | F41A 21/02 42/76.01 |
| 5,650,586 | A | 7/1997 | Balbo | |
| 5,692,334 | A | 12/1997 | Christensen | |
| 5,753,846 | A | 5/1998 | Koon | |
| 5,794,374 | A | 8/1998 | Crandall | |
| 5,804,756 | A | 9/1998 | Christensen | |
| 5,856,631 | A | 1/1999 | Julier | |
| 5,915,937 | A | 6/1999 | Christensen | |
| 5,928,799 | A | 7/1999 | Sherman | |
| 6,189,431 | B1 | 2/2001 | Danner | |
| 6,230,429 | B1 | 5/2001 | Smith | |
| 6,314,857 | B1 | 11/2001 | Schmidt et al. | |
| 6,355,338 | B1 | 3/2002 | Hilmas | |
| 6,497,065 | B1 | 12/2002 | Huston | |
| 6,838,162 | B1 | 1/2005 | Gruber | |
| 6,889,464 | B2 | 5/2005 | Degerness | |
| 6,971,314 | B2 | 12/2005 | Maguire | |
| 7,353,741 | B2 | 4/2008 | Brixius | |
| 7,721,478 | B2 | 5/2010 | Withers | |
| 7,775,200 | B2 | 8/2010 | Anderson | |
| 7,810,272 | B2 | 10/2010 | Brixius | |
| 7,866,079 | B2 | 1/2011 | Keeney et al. | |
| 7,921,590 | B2 | 4/2011 | Briggs | |
| 7,934,332 | B2 | 5/2011 | Briggs | |
| 8,161,753 | B2 | 4/2012 | Benoit | |
| 8,281,698 | B2 | 10/2012 | Haywood | |
| 8,312,663 | B2 | 11/2012 | Johnson | |
| 8,316,568 | B2 | 11/2012 | Briggs | |
| 8,336,243 | B2 | 12/2012 | Langevin | |
| 8,677,670 | B2 | 3/2014 | Christensen et al. | |
| 8,844,187 | B2 | 9/2014 | Pfersmann et al. | |
| 9,222,756 | B1 | 12/2015 | Battaglia | |
| 9,658,010 | B1 | 5/2017 | Oglesby | |
| 9,796,057 | B2 * | 10/2017 | Tertin | F41A 21/02 |
| 9,823,034 | B2 | 11/2017 | Johnson et al. | |
| 10,066,898 | B1 | 9/2018 | Coburn et al. | |
| 10,113,824 | B2 * | 10/2018 | Kowalski | B32B 15/04 |
| 10,365,061 | B1 * | 7/2019 | Painter | F41A 5/26 |
| 10,533,820 | B2 * | 1/2020 | McMillan | F41A 21/10 |
| 10,584,933 | B2 | 3/2020 | Lagenbeck | |
| 10,690,440 | B2 | 6/2020 | Coburn et al. | |
| 10,907,921 | B1 * | 2/2021 | Painter | F41A 5/26 |
| 10,907,942 | B2 | 2/2021 | Greenwood | |
| 11,079,194 | B1 * | 8/2021 | Sinnema | F41A 21/02 |
| 11,385,013 | B2 | 7/2022 | Boretto et al. | |
| 11,680,765 | B1 * | 6/2023 | Painter | F41A 21/44 89/16 |
| 11,732,988 | B2 | 8/2023 | Boretto et al. | |
| 12,050,074 | B1 | 7/2024 | Painter | |
| 2002/0078616 | A1 * | 6/2002 | Perry | F41A 21/04 42/76.01 |
| 2004/0244257 | A1 | 12/2004 | Degerness | |
| 2005/0108916 | A1 * | 5/2005 | Keeney | F41A 21/02 42/76.02 |
| 2005/0115398 | A1 | 6/2005 | Olson | |
| 2005/0132872 | A1 | 6/2005 | Jansen | |
| 2005/0229464 | A1 | 10/2005 | Olson et al. | |
| 2005/0262997 | A1 | 12/2005 | Brixius | |
| 2006/0207152 | A1 | 9/2006 | Lazor | |
| 2006/0236582 | A1 | 10/2006 | Lewis | |
| 2007/0256345 | A1 | 11/2007 | Hall | |
| 2008/0143005 | A1 | 6/2008 | Lim | |
| 2010/0162608 | A1 | 7/2010 | McCann | |
| 2011/0100204 | A1 | 5/2011 | Schlenkert | |
| 2011/0107647 | A1 | 5/2011 | Johnson | |
| 2011/0119981 | A1 | 5/2011 | Larue | |
| 2011/0146130 | A1 | 6/2011 | Emde | |
| 2011/0173864 | A1 | 7/2011 | Christensen et al. | |
| 2011/0265365 | A1 * | 11/2011 | Alonso Tricio | F41A 21/24 42/78 |
| 2011/0277623 | A1 | 11/2011 | Adolphsen | |
| 2012/0180358 | A1 | 7/2012 | Samson | |
| 2012/0227302 | A1 | 9/2012 | Fonte | |
| 2013/0036902 | A1 | 2/2013 | Adolphsen | |
| 2013/0061503 | A1 | 3/2013 | Klett et al. | |
| 2013/0247439 | A1 | 9/2013 | Johnson | |
| 2013/0276342 | A1 | 10/2013 | Chvala | |
| 2014/0030519 | A1 | 1/2014 | Morimoto et al. | |
| 2014/0076135 | A1 | 3/2014 | Balthaser et al. | |
| 2014/0082990 | A1 | 3/2014 | Lee | |
| 2015/0369558 | A1 | 12/2015 | Gottzmann | |
| 2016/0109204 | A1 | 4/2016 | Leone | |
| 2016/0209144 | A1 * | 7/2016 | Tertin | B23P 11/025 |
| 2016/0290761 | A1 | 10/2016 | Cook, Jr. | |
| 2017/0138692 | A1 | 5/2017 | Tubb | |
| 2017/0205172 | A1 * | 7/2017 | Curliss | F41A 21/16 |
| 2017/0299299 | A1 | 10/2017 | Klett et al. | |
| 2018/0017350 | A1 | 1/2018 | Kowalski | |
| 2018/0023913 | A1 * | 1/2018 | Newman | F41A 21/04 42/76.1 |
| 2018/0202736 | A1 * | 7/2018 | Teetzel | F41A 11/02 |
| 2018/0238652 | A1 * | 8/2018 | Leone | F41A 21/28 |
| 2018/0238653 | A1 * | 8/2018 | Kunsky | F41A 21/30 |
| 2019/0024999 | A1 | 1/2019 | Aldophsen | |
| 2019/0226786 | A1 | 7/2019 | Sloan | |
| 2021/0252352 | A1 | 8/2021 | Greenwood et al. | |
| 2022/0163280 | A1 * | 5/2022 | Boretto | F41A 21/04 |
| 2024/0133649 | A1 * | 4/2024 | Boretto | F41A 21/04 |
| 2024/0240896 | A1 * | 7/2024 | Ricci | F41A 21/30 |

OTHER PUBLICATIONS

Volquartsen Lightweight Rifle; https://volquartsen.com/products/1060-lightweight; accessed Jun. 8, 2026 (2pgs).

Volquartsen Lightweight Rifle THM Barrel; https://volquartsen.com/inventory_configurations/832; accessed Jun. 8, 2026 (2 pgs).

Bergara BXR Carbon; https://www.bergara.online/us/rifles/rimfire/bxrcarbon; accessed Jun. 8, 2026 (6 pgs).

Bergara BMR-X Carbon; https://www.bergara.online/us/rifles/rimfire/bmr-x-carbon; accessed Jun. 8, 2026 (8 pgs).

Christensen Arms Ranger; https://cristensenarms.com//product/ranger; accessed Jun. 8, 2026 (12 pgs).

MagnumResearchMagnumLite; https://magnumresearch.com/magnum-research-inc-introduces-newly-re-engineered-semi-auto-magnum-lite-22-win-mag-rifle-series; accessed Jun. 8, 2026 (5 pgs.

PWS T3 Summit; https://www.thetruthaboutguns.com/gun-review-pws-t3-summit-rifle; accessed Jun. 8, 2026 (54 pgs).

Correspondence from Kevin Reid to Patrick Fleis dated Feb. 27, 2025 (4 pgs).

Grey Birch Manufacturing LDR Fusion Product Manual; downloaded on Jun. 8, 2026; 6 pgs.

Grey Birch Manufacturing Fusion; https://gbmfg.co/fusion16-1-carbon; accessed on Jun. 8, 2026 (9 pgs).

* cited by examiner

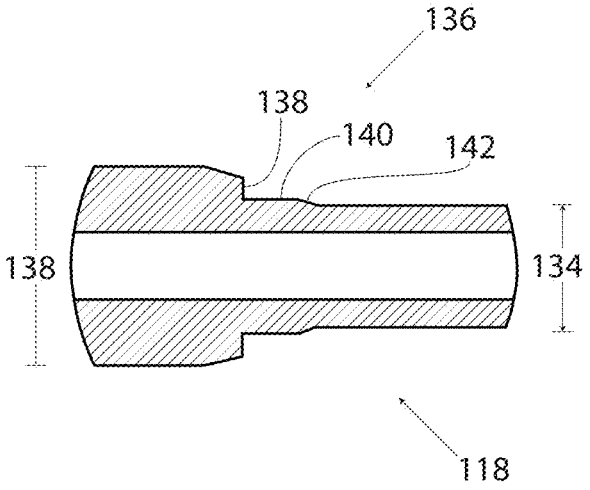
Fig. 16
Fig. 17
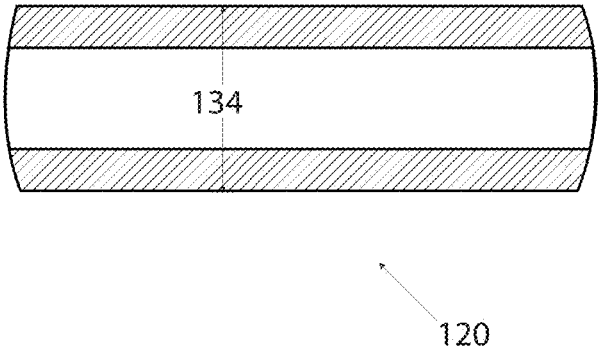
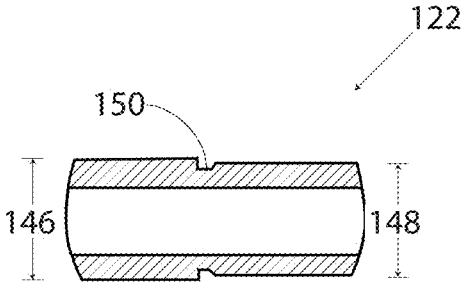
Fig. 18

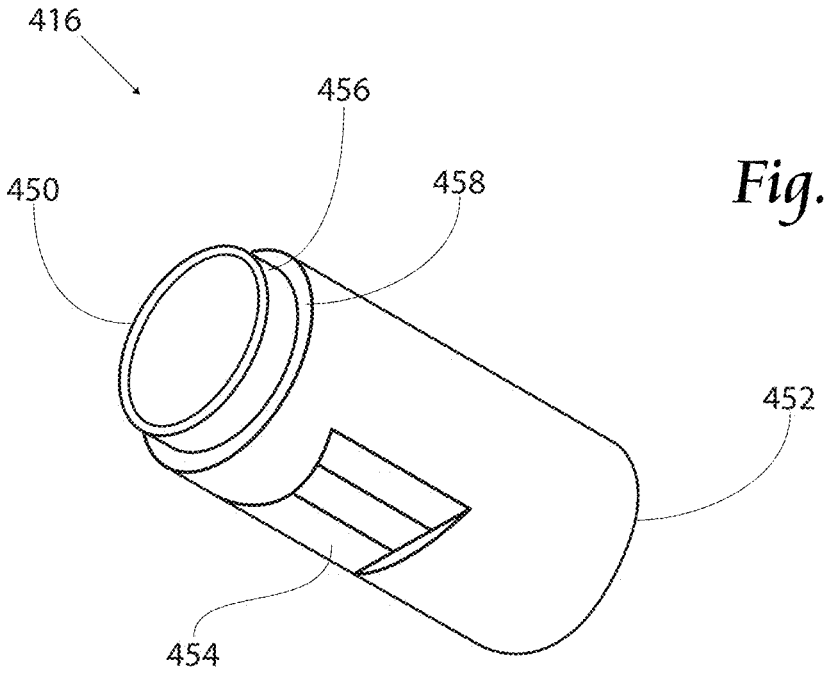
Fig. 46
Fig. 47
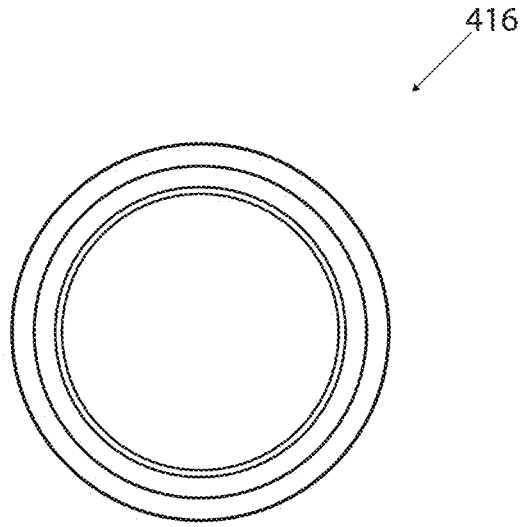

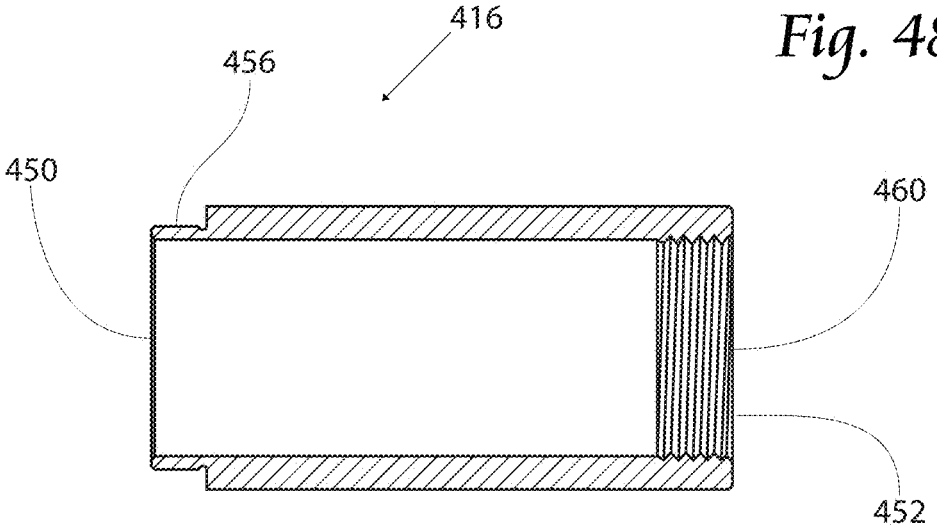
Fig. 48
Fig. 49
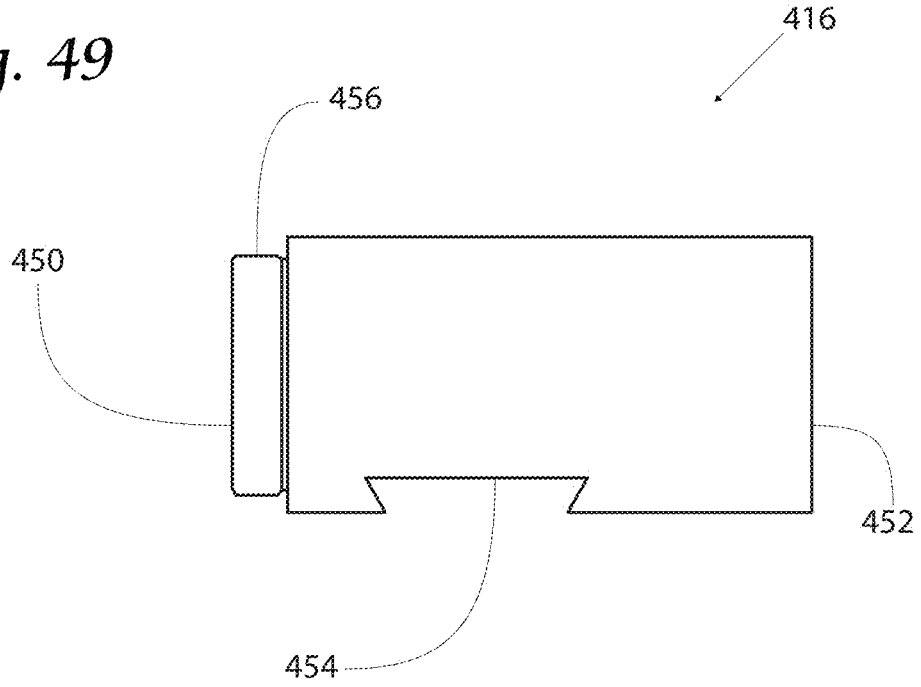

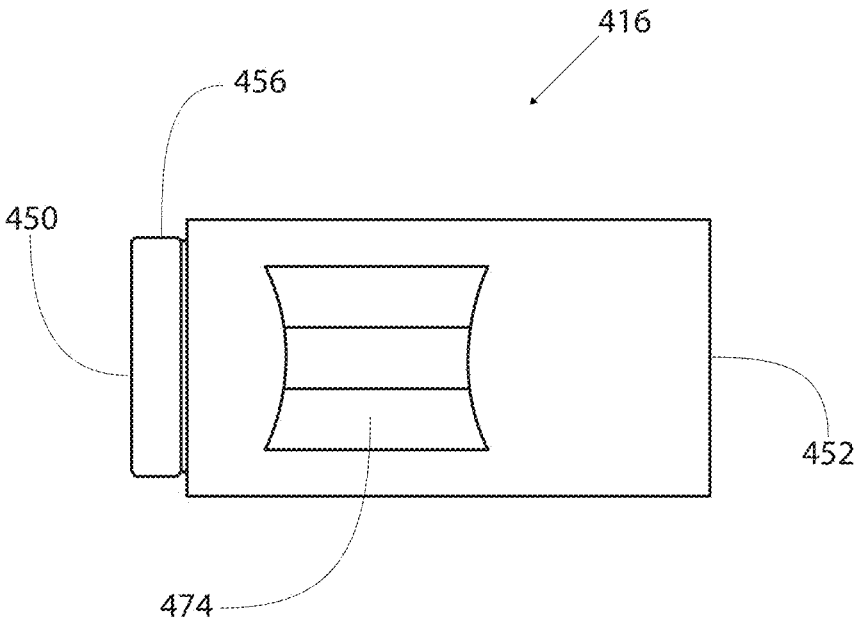
Fig. 50
Fig. 51
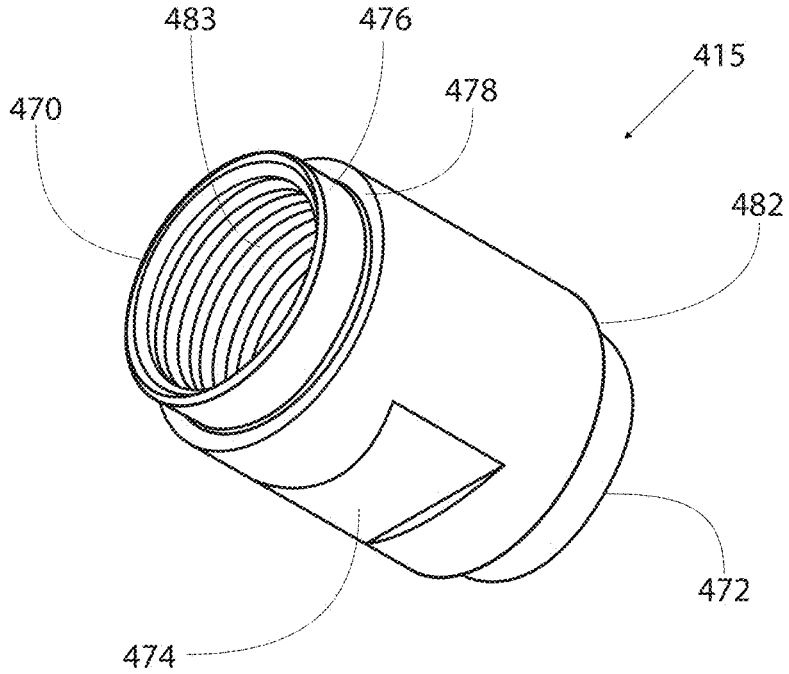

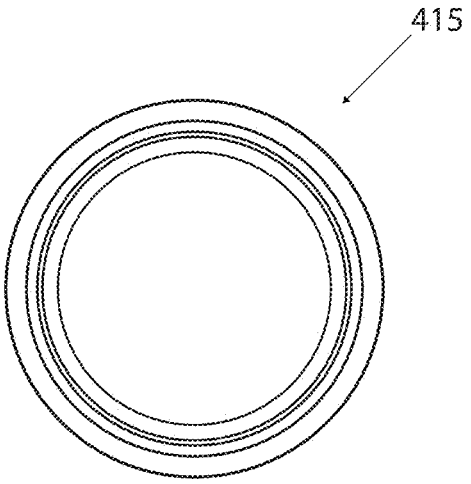
*Fig. 52*
*Fig. 53*
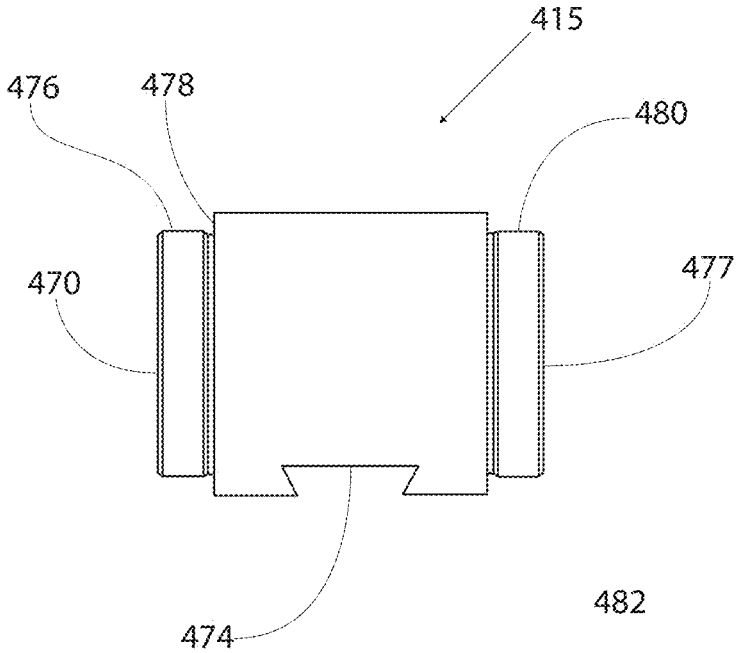

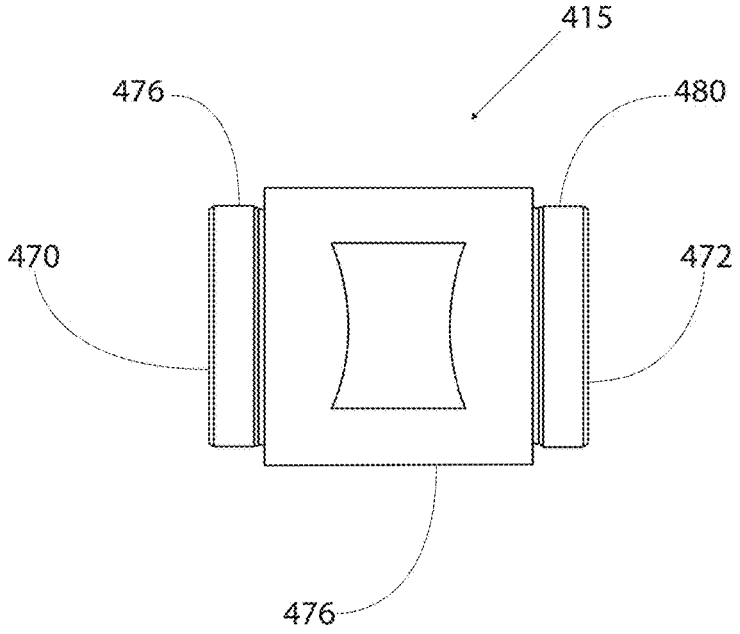
Fig. 54
Fig. 55
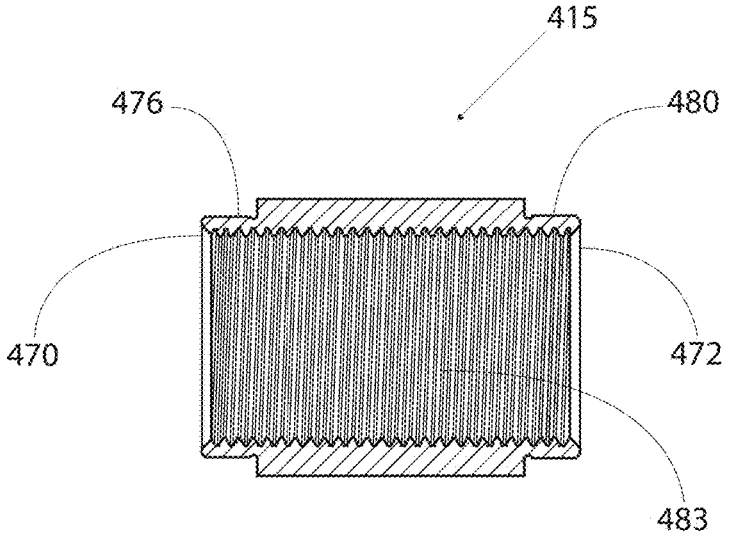

FIREARM BARREL FOR LEVER ACTION FIREARM

CROSS-REFERENCE TO RELATED APPLICATIONS

This application is a Continuation-In-Part of co-pending patent application Ser. No. 18/583,620 filed 21 Feb. 2024.

BACKGROUND OF THE INVENTION

The present invention relates to barrels used in firearms, and, more particularly to a lever action firearm. Lever action firearms are typically rifles, but could also be shotguns and even pistols.

Lever action firearms generally have a cocking handle or bolt handle located around the trigger guard. The cocking handle is manually operated to move a bolt of the firearm to feed or remove cartridges in and out of the firearm chamber, and cock the firing mechanism to allow the firearm to be fired.

As with firearms in general, one of the areas of issue or concerns with lever action firearms is the accuracy of the firearm and the ability to handle the firearm after being fired. The barrel of the firearm tends to heat up after continuous use and the accuracy may diminish, as well. Thus, a need exists for a lever action firearm barrel with improved accuracy and ease of handling.

SUMMARY OF THE INVENTION

The present invention is directed towards a firearm barrel for a lever action firearm. The barrel generally comprises an inner barrel and an outer sleeve. The inner barrel has a support area for receiving the outer sleeve. A muzzle keeper is attached to the end of the outer barrel.

BRIEF DESCRIPTION OF DRAWINGS

FIG. 16 is a close-up view of the inner barrel of the area of line 16-16 of FIG. 14.

FIG. 17 is a close-up view of the inner barrel of the area of line 17-17 of FIG. 14.

FIG. 18 is a close-up view of the inner barrel of the area of line 15-15 of FIG. 14.

FIG. 46 is a perspective view of a muzzle keeper or sleeve nut used with the firearm barrel shown in FIG. 43.

FIG. 47 is a front planar view of the muzzle keeper shown in FIG. 46.

FIG. 48 is a cross-sectional view of the muzzle keeper shown in FIG. 46.

FIG. 49 is a side planar view of the muzzle keeper shown in FIG. 46.

FIG. 50 is a bottom planar view of the muzzle keeper shown in FIG. 46.

FIG. 51 is a perspective view of a bushing used with the firearm barrel shown in FIG. 43.

FIG. 52 is a front planar view of the bushing shown in FIG. 51.

FIG. 53 is a side planar view of the bushing shown in FIG. 51.

FIG. 54 is a bottom planar view of the bushing shown in FIG. 51.

FIG. 55 is a cross-sectional view of the bushing shown in FIG. 51.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
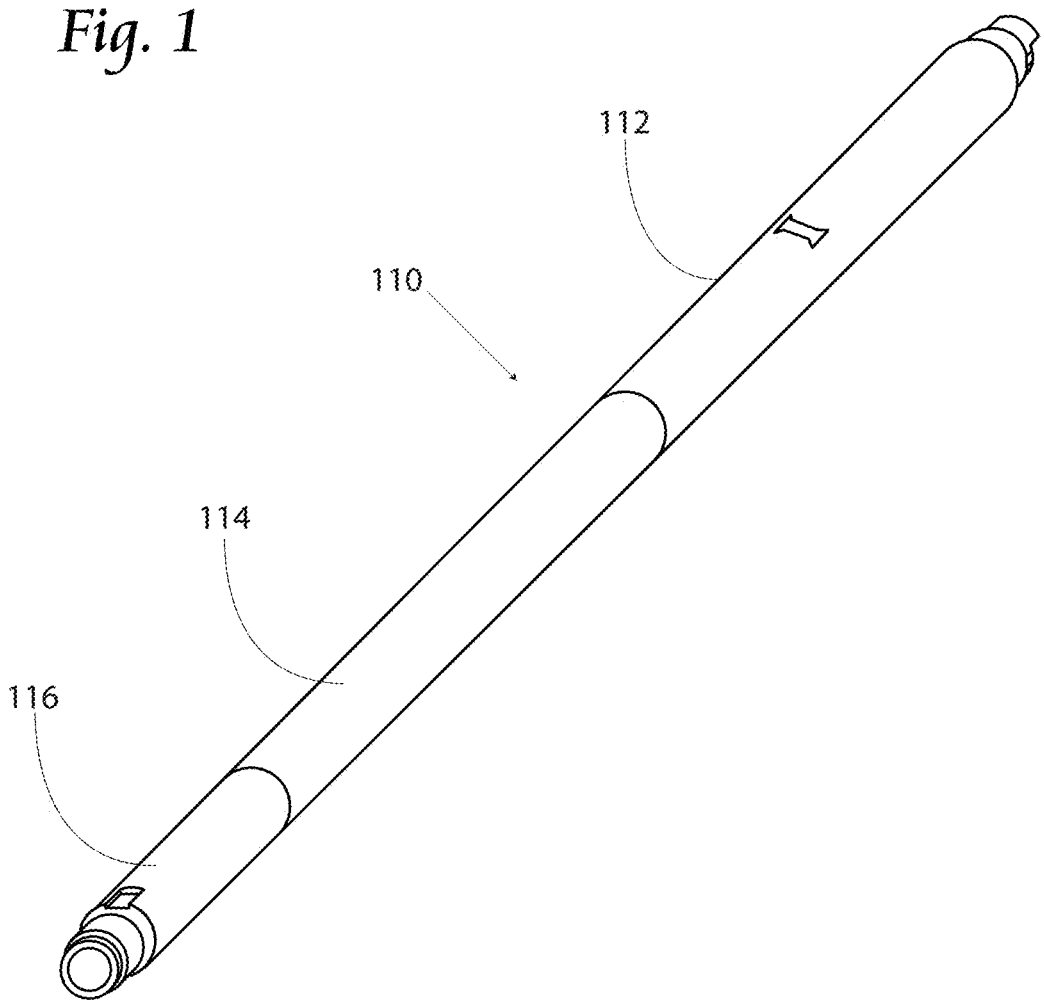
FIG. 1 is a perspective view of an inner barrel for a firearm barrel according to the present invention.

FIG. 1 is a perspective view of a firearm barrel 10 according to the present invention. The firearm barrel 10 is designed specifically for use with a lever action firearm. The barrel 10 generally comprises an inner barrel 12 an outer sleeve 14 and a muzzle keeper 16. The inner barrel 12 is preferably machined from a metal material such as steel, e.g. stainless steel. As will be appreciated further in the discussion below, the arrangement and materials of the firearm barrel 10 provide an advantageous device compared to prior art firearms.

Figure 2:
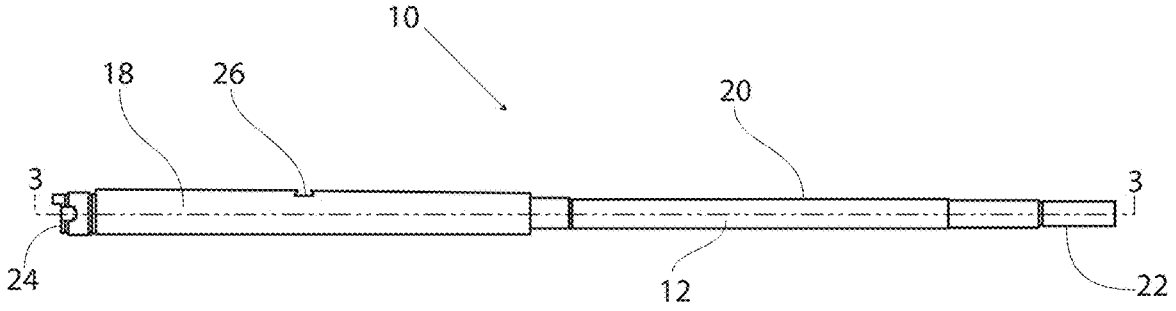
FIG. 2 is a side view of the firearm barrel of FIG. 1.

FIG. 2 shows a side view of the inner barrel 12. The inner barrel 12 has a rear section 18, an intermediate section 20 and a front section 22. The rear section 18 provides an area for the forearm of a firearm (not shown) to be attached to the firearm barrel 10. The intermediate section provides an area for the outer sleeve 14 to be situated, and the front section 22 provides an area for the muzzle keeper 16 to be positioned.

Still referring to FIG. 2, the rear section 18 further comprises an attachment end 24 that allows the barrel 10 to be attached or coupled to the gun's firing chamber (not shown), and the rear section 18 also has an attachment area 26 for a rear site (not shown). The diameter of the rear section 18 is also greater than the diameter of the intermediate section 20 and the front section 22.

Figure 3:
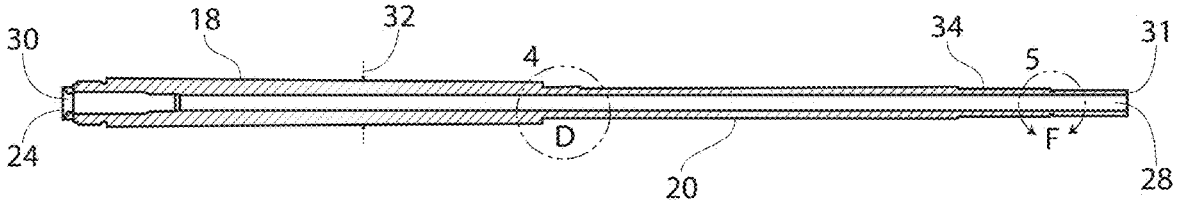
FIG. 3 is a cross-sectional view of the firearm barrel of FIG. 1.
Figure 4:
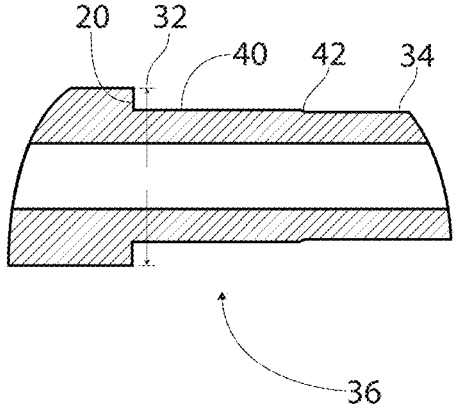
FIG. 4 is close-up view of the firearm barrel taken along line 4-4 of FIG. 3.

FIG. 3 provides a cross-sectional view of the inner barrel 12. The inner barrel 12 comprises an elongated tube 28 having an entrance end 30 and an exit end 31. The inner barrel 12 has a first outer diameter (OD) 32 for the rear section 18, and a second OD 34 for the intermediated section 20. As can be seen more clearly in the close-up view in FIG. 4, the first OD 32 transfers to the second OD 34 by way of a support area 36. The support area 36 comprises an abutment wall 38, which leads down to a support shelf 40 for the outer sleeve 14 to rest upon (see FIG. 10). Preferably the abutment wall 38 and the support shelf 40 form a right angle so that the outer sleeve 14 will tightly abut the inner barrel 12. A tapered section 42 extends from the support shelf 40 to the second OD 34, which will provide for a slight gap 44 (see FIG. 9) when the outer sleeve 14 is assembled onto the inner barrel 12. For example, in a preferred embodiment, the gap 44 would be approximately 0.002".

Figure 5:
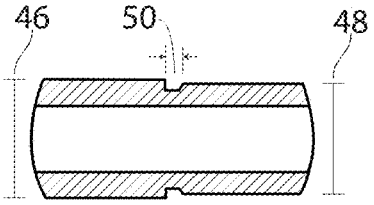
FIG. 5 is a close-up view of the firearm barrel taken along line 5-5 of FIG. 3.

Referring further to FIG. 3, the inner barrel 12 also has a third OD 46 and a fourth OD 48, which both are formed on the front section 22 to accommodate the eventual attachment of the muzzle keeper 16. As shown in the close-up view of FIG. 5, the front section 22 transitions from the third OD 46 to the fourth OD by way of a notch 50, which will matingly receive the muzzle keeper 16 for a secure arrangement.

Figure 6:
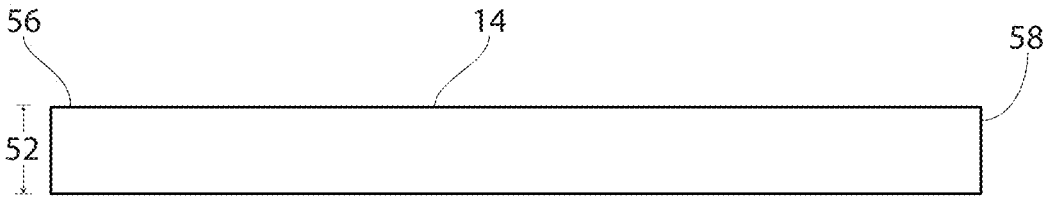
FIG. 6 is a side view of an outer sleeve for a firearm barrel according to the present invention.
Figure 6A:
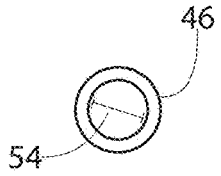
FIG. 6A is a front view of the outer sleeve shown in FIG. 6.

Turning now to FIG. 6 and FIG. 6A, a planar view of the outer sleeve 14 is shown. The outer sleeve 14 has an OD 52 and an inner diameter (ID) 54, as well as a first end 56 and a second end 58. The OD 52 is preferably equal to the first OD 32 of the inner barrel 12, while the ID 54 of the outer sleeve 14 is such that the first end 56 will nest and sit on the support shelf 40. The outer sleeve 14 may be made of any suitable material, but is preferably made of carbon fiber material, which contributes to the capability of the firearm barrel 10 to dissipate heat when fired and allow for quicker and easier handling after firing. Likewise, the slight gap 44 also provides for dissipation of heat, as the outer sleeve 14 is not directly in contact with the inner barrel 12 along the majority, e.g. the intermediate section 18 of the inner barrel 12.

Figure 7:
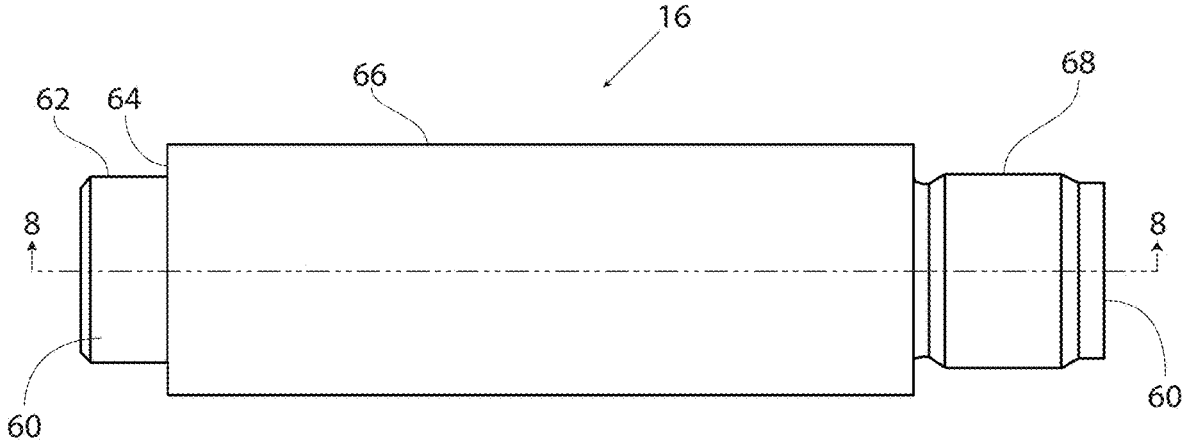
FIG. 7 is a side view of a muzzle keeper used with the present invention.
Figure 7A:
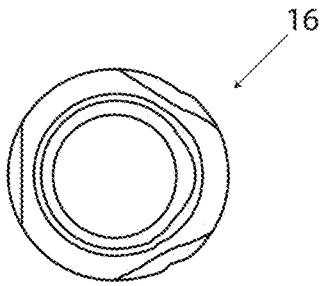
FIG. 7A is a front view of the muzzle keeper of FIG. 7
Figure 8:
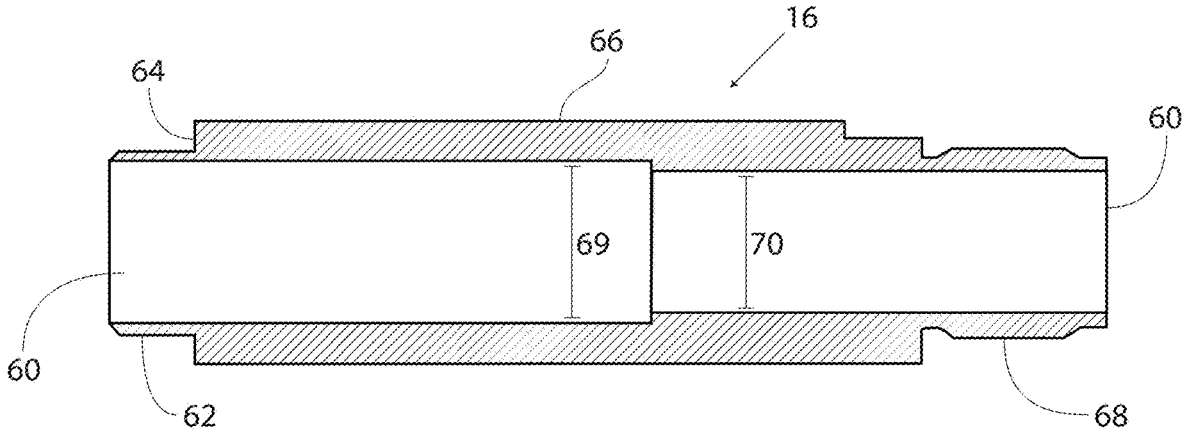
FIG. 8 is a cross-sectional view of the muzzle keeper shown in FIG. 7 taken along the line 8-8 of FIG. 7.

FIG. 7 (planar), FIG. 7A (front view) and FIG. 8 (cross-sectional) depict the muzzle keeper 16. As discussed above, the muzzle keeper 16 will be situated on the front section 22 of the inner barrel 12. The muzzle keeper 16 has a first end 60 that will be inserted over the inner barrel 12 and will provide a front support 62 for the outer sleeve 14. The muzzle keeper 16 also has an abutment wall 64 for the outer sleeve 14 to fit against when the barrel 10 is fully assembled. The muzzle keeper also has a second end 66 that will is located at the exit end 31 of the inner barrel 12 when fully assembled. The muzzle keeper generally has a main body 66 and a muzzle 68 section, with the main body 66 having an OD substantially equal to the OD the outer sleeve 14 and that of the rear section 16 of the inner barrel 12.

Still referring to FIG. 8, the muzzle keeper 16 transitions from a first ID 69 to a second ID 70, with the second ID 70 being less than that of the first ID. This allows for the muzzle keeper 16 to matingly fit within the notch 50, as discussed above.

Figure 9:
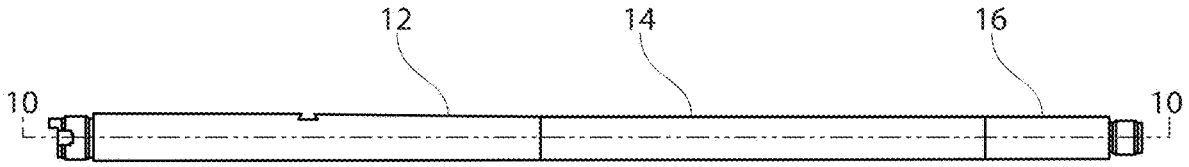
FIG. 9 is planar side view of an assembled firearm barrel according to the present invention.
Figure 10:
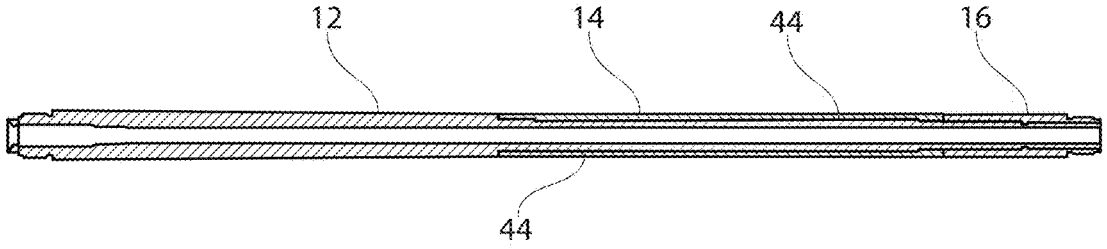
FIG. 10 is a cross-sectional view of the barrel of FIG. 9 taken along the line 10-10.

The resultant assembled barrel 10 is shown in FIGS. 9 and 10. As is appreciated in the planar view in FIG. 10, the three main sections of the firearm barrel 10 fit securely together with one another, with the OD of the barrel consistent along the length of the barrel 10. In the same fashion, the cross-sectional view shown in FIG. 10 demonstrates the improved barrel 10 of the present invention.

Figure 11:
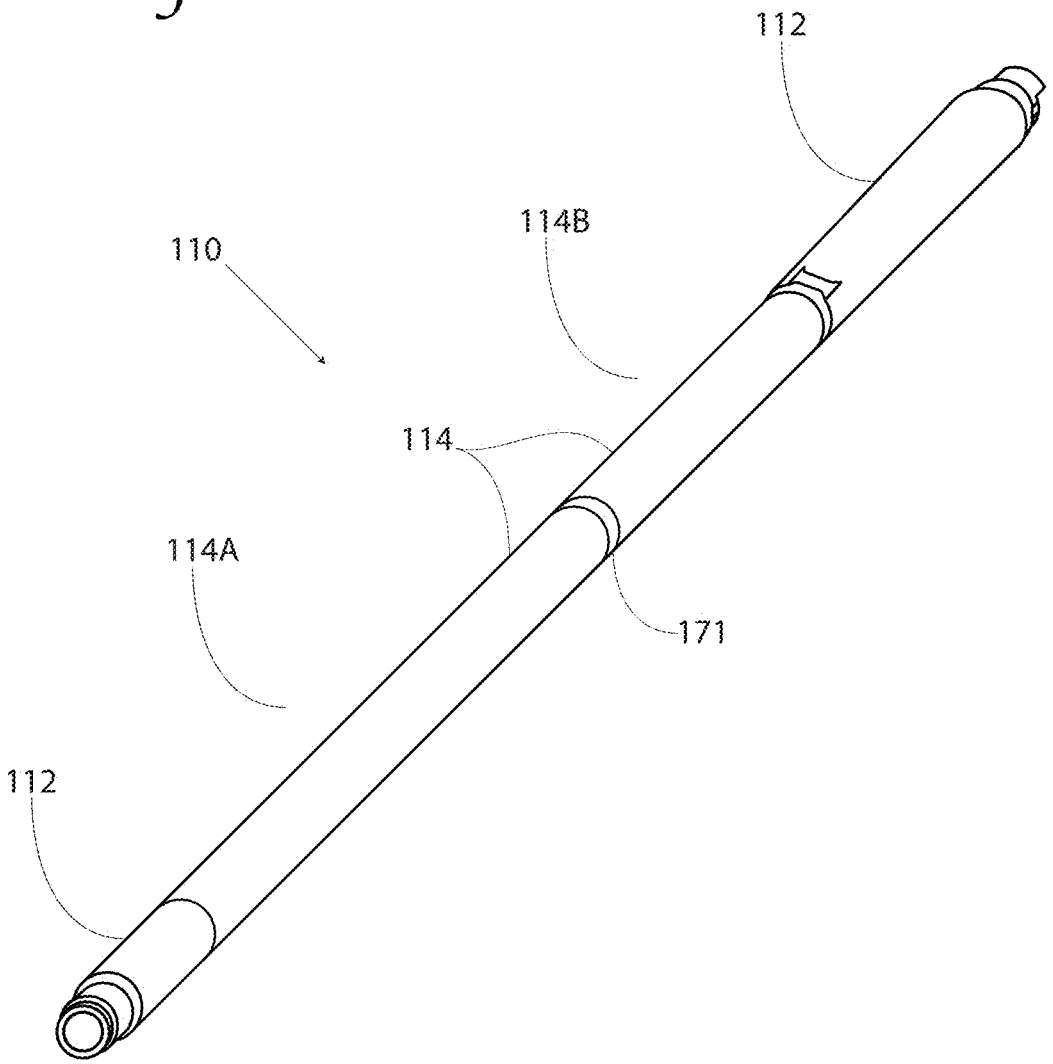
FIG. 11 is a perspective view of an alternate embodiment of a firearm barrel according to the present invention.

FIG. 11 shows a perspective view of a second embodiment of a firearm barrel 110 according to the present invention. The second embodiment 110 is similar to that of the barrel 10, with the second embodiment also having an inner barrel 112, an outer sleeve 114, and a muzzle keeper 116 as described for the barrel 10. The second embodiment 110 differs in that the barrel 110 further incorporates a gas bushing 171, as will be discussed below.

Figure 12:
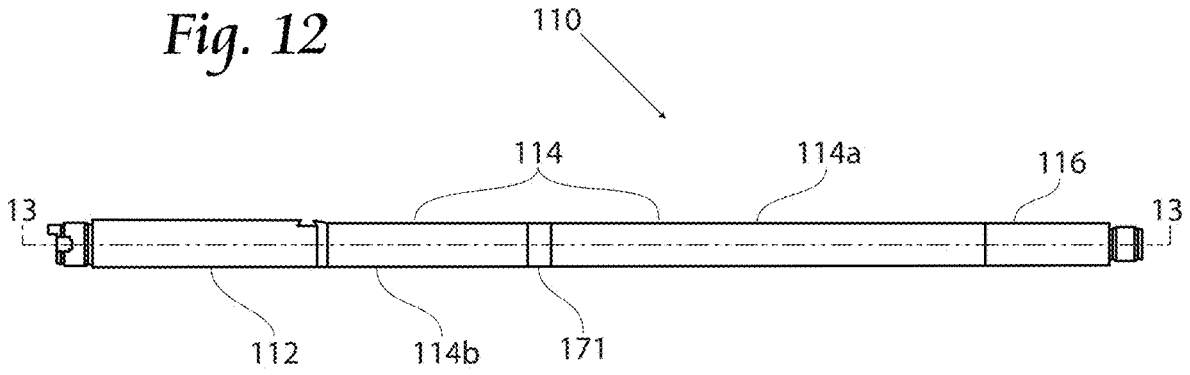
FIG. 12 is a planar side view of the barrel shown in FIG. 11.

FIG. 12 provides a planar view of the firearm barrel 110. As noted, the barrel 110 comprises the inner barrel 112 and the muzzle keeper 116, in the same fashion as similar parts described for the firearm barrel 10, discussed above. The outer sleeve 114 differs from the outer sleeve 14 in that it is comprised of two separate sections, a front section 114*a* and a rear section 114*b*. Preferably, the front section 114*a* is longer than the rear section 114*b*.

Figure 13:
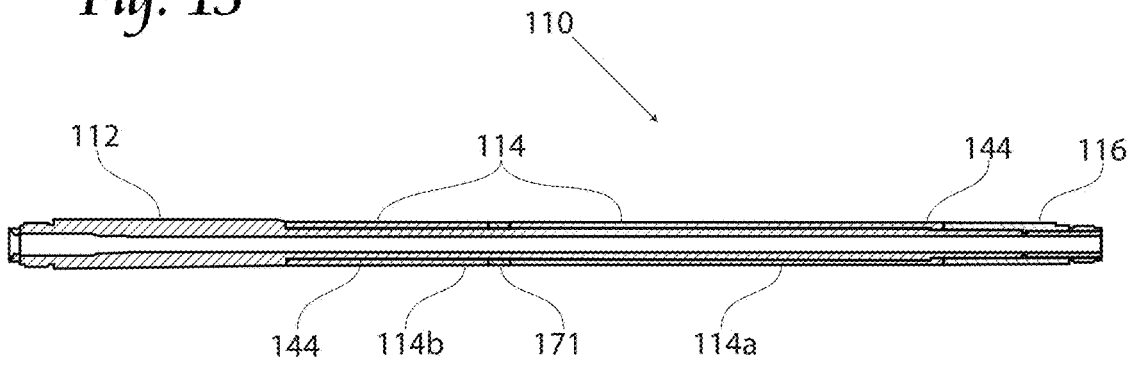
FIG. 13 is a cross-sectional view of the barrel of FIG. 12 taken along the line 13-13 of FIG. 12.

The arrangement of the outer sleeve 114 is further exemplified in the cross-sectional view of firearm barrel 110 shown in FIG. 13. The gas bushing 171 is situated between the front section 114*a* and the rear section 114*b*. As will be appreciated from the discussion below, the gas bushing 171 provides a support for both sections 114*a*, 114*b* to maintain a gap 144 between the outer sleeve 114 and the inner barrel 112.

Figure 14:
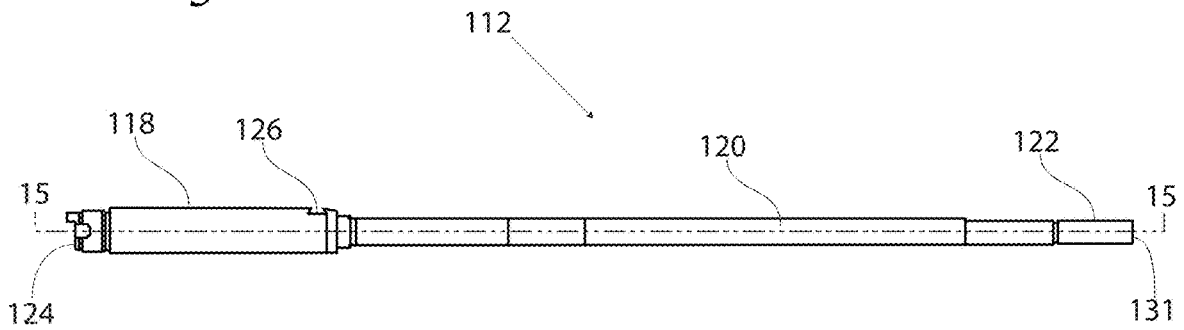
FIG. 14 is side view of an inner barrel used in the embodiment shown in FIG. 11.

FIG. 14 shows a side view of the inner barrel 112. The inner barrel 112 has a rear section 118, and intermediate section 120 and a front section 122. The rear section 118 provides an area for the forearm of a firearm (not shown) to be attached to the firearm barrel 110. The intermediate section 120 provides for an area for the outer sleeve sections 114*a*, 114*b*, as well as the gas bushing 171 to be situated, and the front section 122 provides an area for the muzzle keeper 116 to be positioned.

Still referring to FIG. 14, the rear section 118 further comprises an attachment end 124 that allows the barrel 110 to be attached or coupled to the firearm's firing chamber (not shown), and the rear section 118 also has an attachment area 126 for a rear site (not shown). The outer diameter of the rear section 118 is also greater than the outer diameter of the intermediate section 120 and the front section 122.

Figure 15:
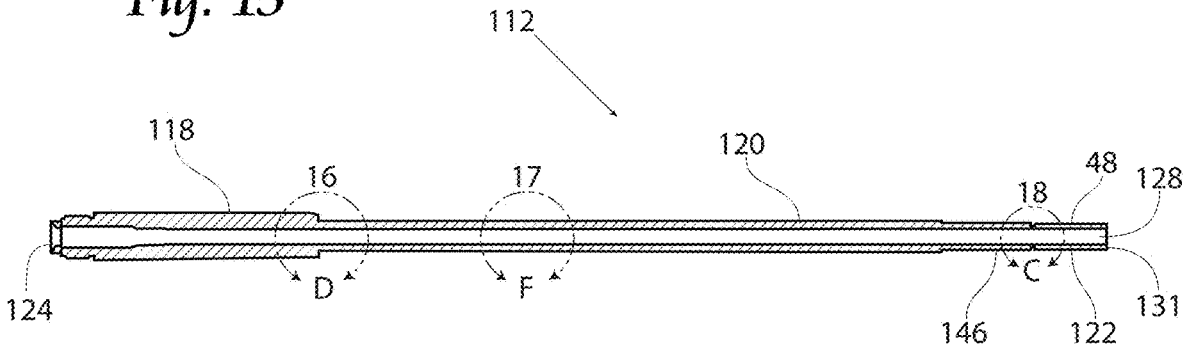
FIG. 15 is a cross-sectional view of the inner barrel of FIG. 14 taken along the line 15-15.

FIG. 15 provides a cross-sectional view of the inner barrel 112. The inner barrel 112 comprises an elongated tube 128 having an entrance end 130 and an exit end 131. The inner barrel 12 has a first outer diameter (OD) 132 for the rear section, and a second OD 134 for the intermediated section 120. As can be seen more clearly in the close-up view in FIG. 16, the first OD 132 transfers to the second OD 134 by way of a support area 136. The support area 136 comprises an abutment wall 138, which leads down to a support shelf 140 for the outer sleeve 114 to rest upon (see FIG. 13). Preferably the abutment wall 138 and the support shelf 140 form a right angle so that the outer sleeve 114 will tightly abut the inner barrel 112 at the abutment wall 138. A tapered section 142 extends from the support shelf 140 to the second OD 134, which will provide for a slight gap 144 (see FIG. 13) when the outer sleeve 114 is assembled onto the inner barrel 112. For example, in a preferred embodiment, the gap 144 would be approximately 0.002".

FIG. 17 shows a close-up view of the central area of the outer sleeve 114 that will support the gas bushing 171 (not shown). FIG. 17 demonstrates that the second OD 134 of the outer sleeve 114 is preferably consistent along the length of the intermediate section 120 of the outer sleeve 114.

Referring again to FIG. 15, the inner barrel 112 also has a third OD 146 and a fourth OD 148, which both are formed on the front section 122 to accommodate the eventual attachment of the muzzle keeper 116. As shown in the close-up view of FIG. 18, the front section 122 transitions from the third OD 146 to the fourth OD 148 by way of a notch 150, which will matingly receive the muzzle keeper 16 for a secure arrangement.

Figure 19:
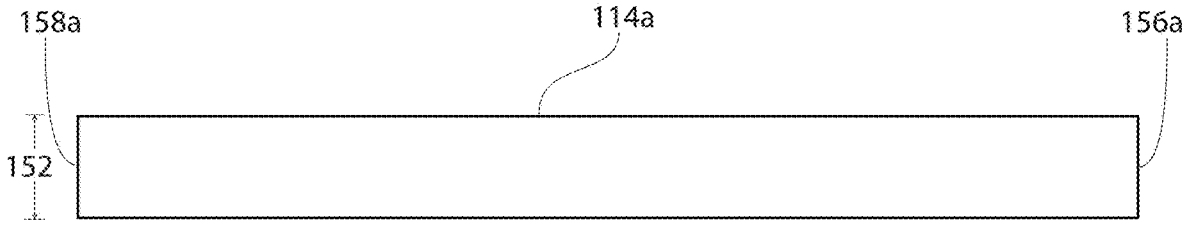
FIG. 19 is planar side view of a rear section of an outer sleeve used in the embodiment of FIG. 11.
Figure 19A:
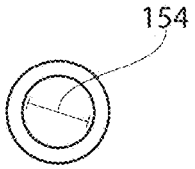
FIG. 19A is a front view of the rear section of FIG. 19.
Figure 20:
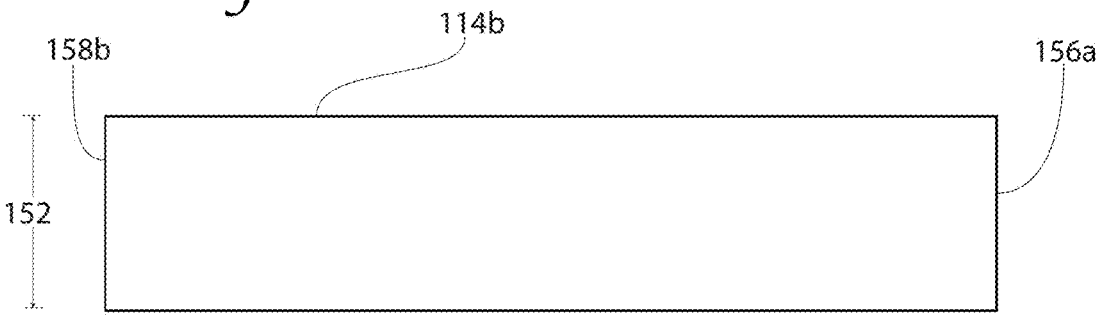
FIG. 20 is a planar side view of a front section of an outer sleeve used in the embodiment of FIG. 11.
Figure 20A:
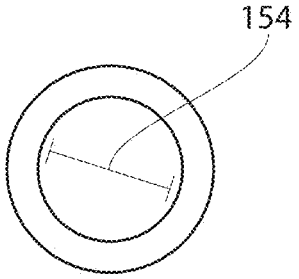
FIG. 20A is a front view of the front section shown in FIG. 20.

Turning now to FIGS. 19 and 20, a planar view of the outer barrel 114 (section 114*a*, FIG. 19, section 114*b*, FIG. 20) is shown. Each section 114*a*, 114*b* of the sleeve 14 has an OD 152 and an inner diameter (ID) 154. Each of the sections 114*a*, 114*b*, has a respective first end 156*a*, 156*b*, and a respective second end 158*a*, 158*b*. The OD 152 is preferably equal to the first OD 132 of the inner barrel 112, while the ID 154 of the outer sleeve 114 is such that the first end 156*a* will nest and sit on the support shelf 140. The outer sleeve 114 may be made of any suitable material, but is preferably made of carbon fiber material, which contributes to the capability of the firearm barrel 110 to dissipate heat when fired and allow for quicker and easier handling after firing. Likewise, the slight gap 144 also provides for dissipation of heat, as the outer sleeve 114 is not directly in contact with the inner barrel 112 along the majority, e.g. the intermediate section 118 of the inner barrel 112.

Figure 21:
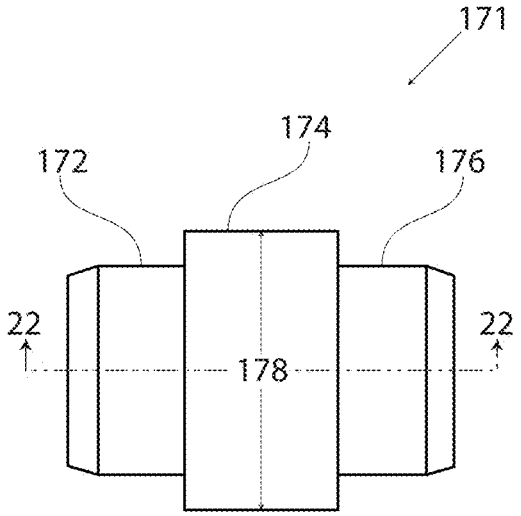
FIG. 21 is a planar side view of a gas bushing used in the embodiment of FIG. 11.
Figure 22:
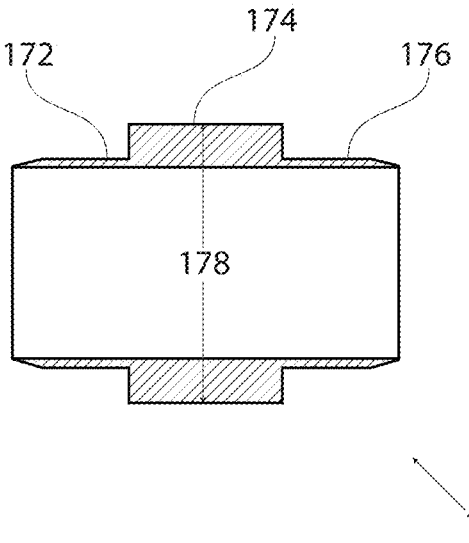
FIG. 22 is cross-sectional view of the gas bushing shown in FIG. 21.

FIG. 21 (planar) and FIG. 22 (cross-sectional) depict the gas bushing 171 used with the firearm barrel 110. The gas bushing 171 generally comprises a front section 172, a central section 174, and a rear section 176. The front section 172 and the rear section 176 have an OD is equal to that of the support shelf 140, to provide support for the outer sleeve sections 114*a* and 114*b*. That is, the rear section 176 will provide support for the second end 158*a*, and the front section 176 will provide support for the front end 156*b*, thereby maintaining the air gap 144 along the intermediate section 118 of the inner barrel 112. The central section 174 has a greater OD 178, essentially equal to the OD of the rear section of the inner barrel.

Figure 23:
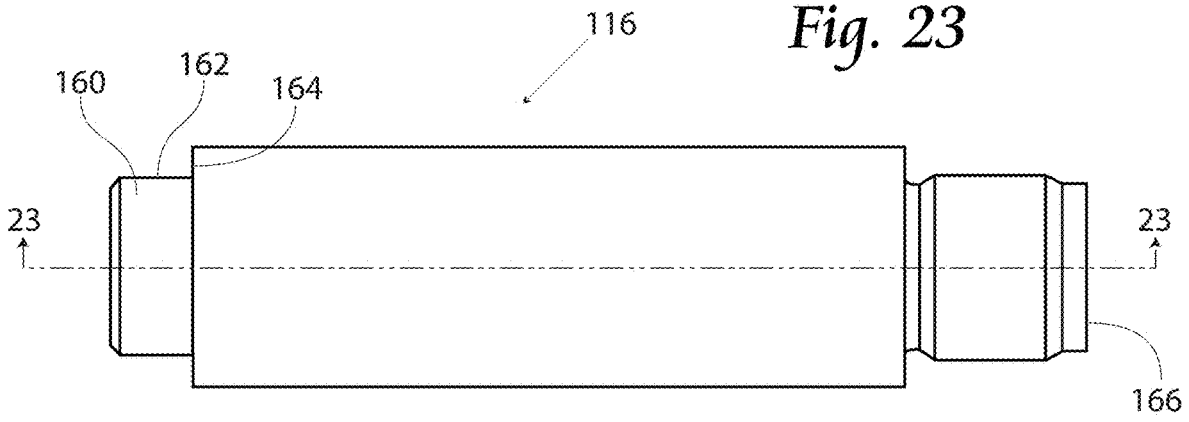
FIG. 23 is planar side view of a muzzle keeper used in the embodiment of FIG. 11.
Figure 23A:
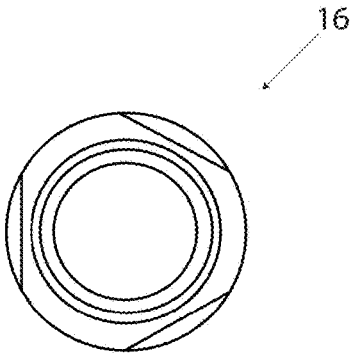
FIG. 23A is a front view of the muzzle keeper of FIG. 23.
Figure 24:
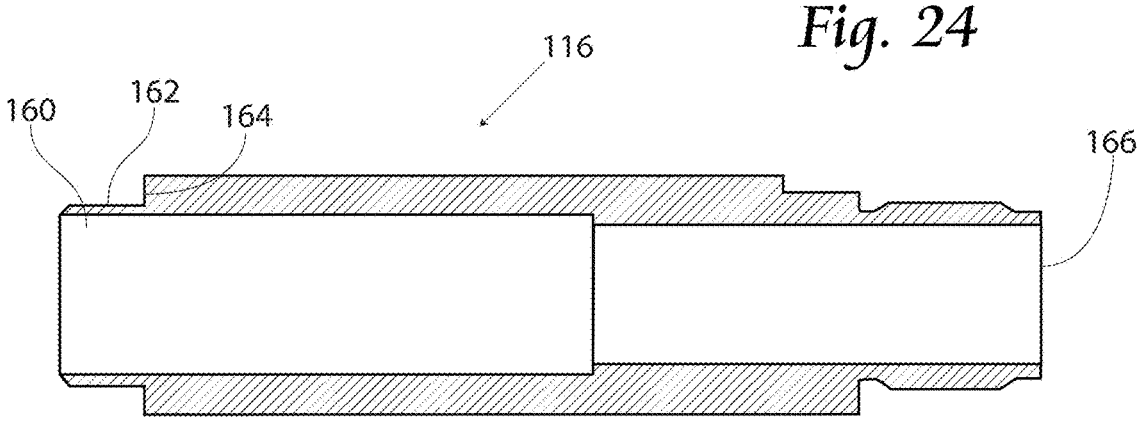
FIG. 24 is a cross-sectional view of the muzzle keeper of FIG. 23.

FIG. 23 (planar), FIG. 23A (front view) and FIG. 24 (cross-sectional) depict the muzzle keeper 116. As discussed above, the muzzle keeper 16 will be situated on the front section 122 of the inner barrel 112. The muzzle keeper 116 has a first end 160 that will be inserted over the inner barrel 112 and will provide a front support 162 for the front end 158*b* of front section 114*a*. The muzzle keeper 116 also has an abutment wall 164 for the front end 158*b* to fit against when the barrel 110 is fully assembled. The abutment wall is preferably forms a right angle with the front support 162. The muzzle keeper 116 also has a second end 166 that will is located at the exit end 131 of the inner barrel 112 when fully assembled. The muzzle keeper generally has a main body 166 and a muzzle 168 section, with the main body 166 having an OD substantially equal to the OD the outer sleeve 114 and that of the rear section 116 of the inner barrel 112.

Still referring to FIG. 23, the muzzle keeper 116 transitions from a first ID 169 to a second ID 170, with the second ID 170 being less than that of the first ID 169. This allows for the muzzle keeper 116 to matingly fit within the notch 150, as discussed above.

The resultant assembled barrel 10 is shown in FIGS. 12 and 13.

Thus, referring again to FIGS. 12 and 13, as with the barrel 10, the three main sections of the firearm barrel 110 fit securely together with one another, with the OD of the barrel consistent along the length of the barrel 110. In the same fashion, the cross-sectional view shown in FIG. 13 demonstrates the improved barrel of the present invention, captured in embodiment 110.

It should be understood that the outer sleeves 14 and 114 are a separate and distinct structure from the inner barrels 12 and 112. That is, while the outer sleeves 14 and 114 can preferably be made of a material such as carbon fiber or other similar mater, the sleeves will still be a solid structure and not a material that is wrapped or adhered onto the outer surface of an inner barrel.

Figure 25:
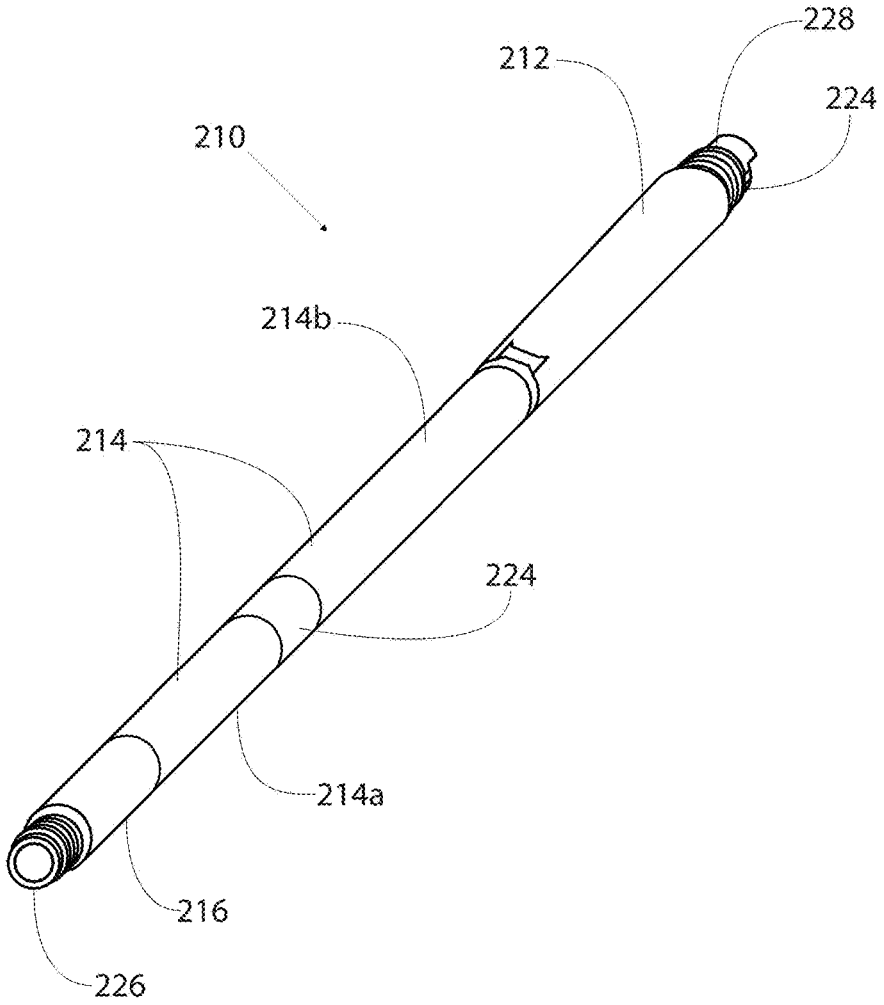
FIG. 25 is an alternate embodiment of a firearm barrel according to the present invention.

FIG. 25 provides another embodiment of a firearm barrel 210. Similar to the firearm barrel 110, the firearm barrel 210 comprises an inner barrel 212 and an outer sleeve 214, with the outer sleeve 214 having a front section 214*a* and a rear section 214*b*. A bushing 215 separates the front section 214*a* and the rear section 214*b*. A threaded nut or muzzle keeper 216 retains the outer sleeve 214 and the bushing 215 on the inner barrel 212.

Figure 26:
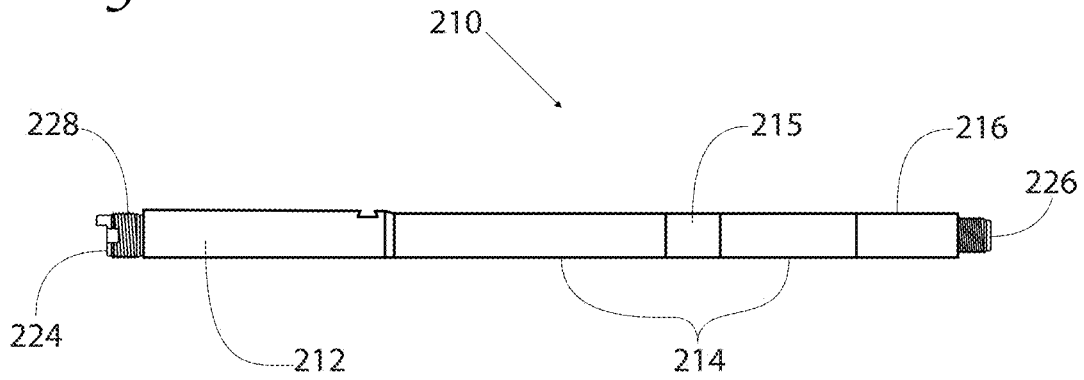
FIG. 26 is a side planar view of the firearm barrel of FIG. 25.

FIG. 26 provides a planar view of the firearm barrel 210. As noted, the barrel 210 comprises the inner barrel 212 and the outer sleeve 214, in the same fashion as described for the firearm barrel 110. The muzzle keeper 216 is threaded onto a threaded end located on the inner barrel 212.

Figure 27:
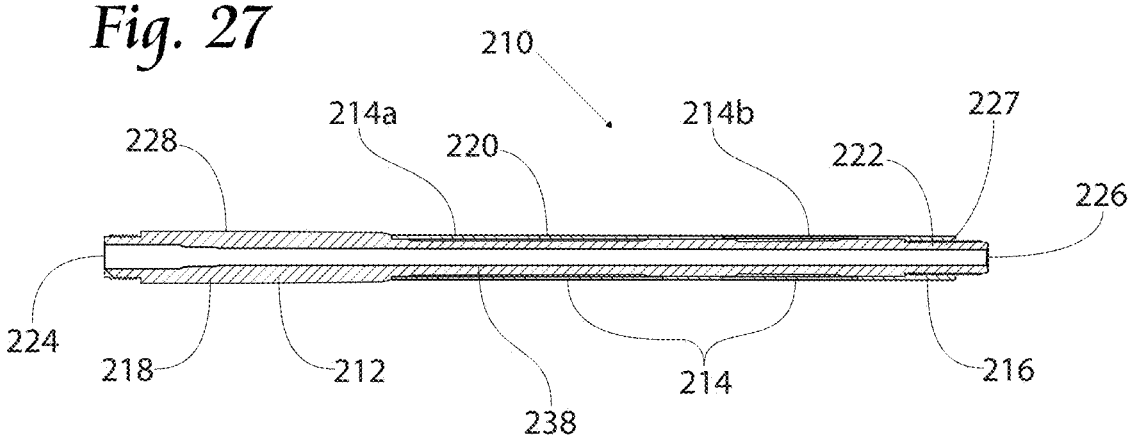
FIG. 27 is a cross-sectional view of the firearm barrel of FIG. 26.

The arrangement of the firearm barrel 210 is further exemplified in the cross-sectional view of shown in FIG. 27. The solid inner barrel 212 has a rear section 218, an intermediate section 220 and a front section 222. The rear section 218 has an entrance end 224 and the front section 222 has an exit end 226. The rear section provides a threaded area 228 for the forearm of a firearm (not shown) to be attached to the firearm barrel 210. The rear section 218 abuts the intermediate section at a first sleeve support section 230 for the rear section 214*b* of the outer sleeve 214. The front section 222 has a threaded portion 223 that will receive the muzzle keeper 216.

Figure 28:
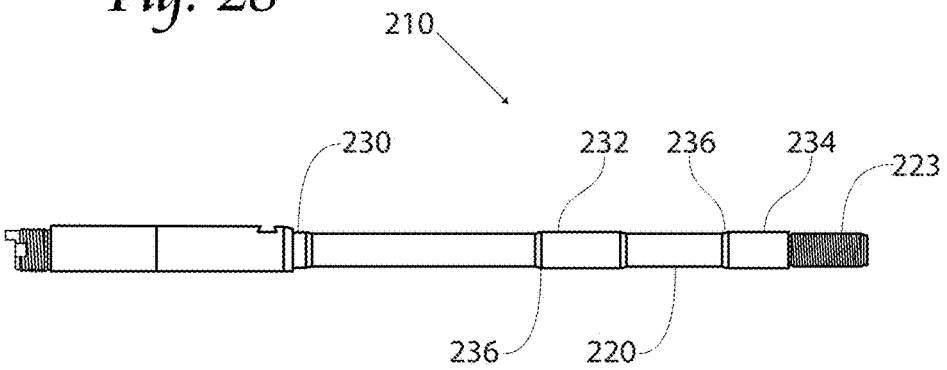
FIG. 28 is a side planar view of an inner barrel of the embodiment shown in FIG. 25.

A planar view of the inner barrel 212 is shown in FIG. 28. The intermediate section 220 further has a second sleeve support section 232 located centrally along the barrel 210. A third sleeve support section 234 is located near the front section 222. Each of the three support sections tapers downwardly to an outer surface 236 having a reduced diameter. The reduced diameter allows for a gap 238 to be formed between the outer surface 236 and the outer sleeve sections 214*a* and 214*b* when inserted over the inner barrel 212 (see FIG. 27).

Figure 29:
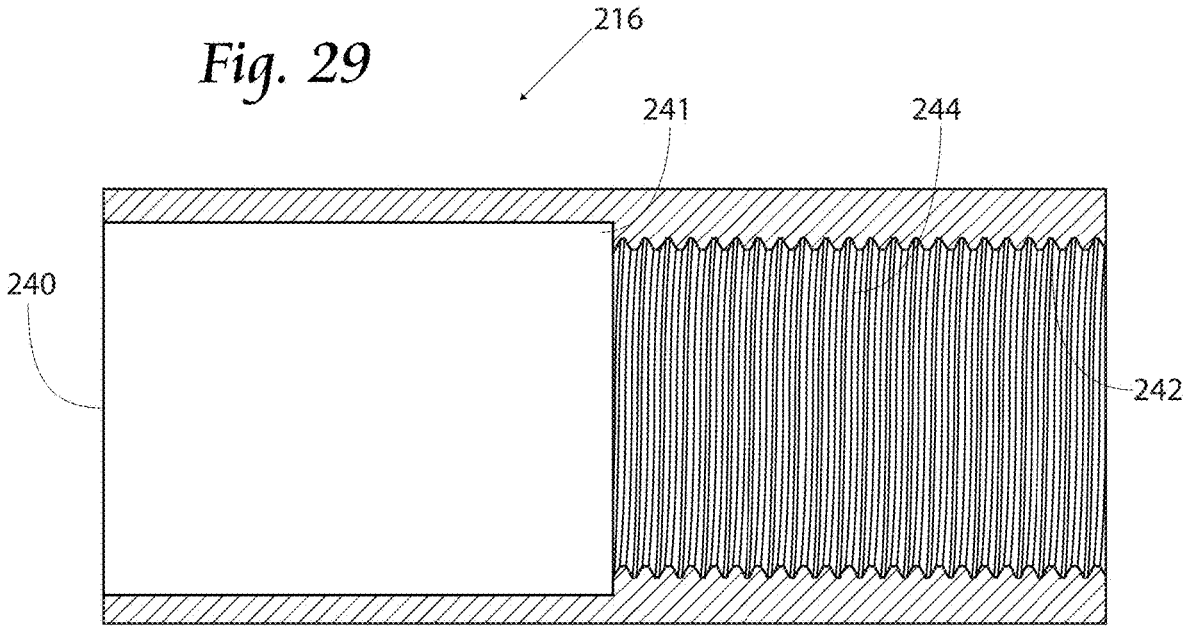
FIG. 29 is a side planar view of a muzzle keeper or sleeve nut according to the present invention and used in the embodiment shown in FIG. 25.

FIG. 29 is a side view of the threaded nut 216. The threaded sleeve nut 216 has a first end 240 that will abut the front sleeve section 214*b* when the barrel 210 is assembled (see FIG. 27). The sleeve nut 216 also has a flange 241 that abuts the third sleeve support section 234 when assembled. The sleeve nut further comprises a threaded surface 244 that can be threaded onto the front section 222 of the inner barrel 210, as discussed above. The threaded surface 244 is threaded onto the sleeve thread 223 to secure the outer sleeve 114 in place. As the sleeve nut 216 is threaded onto the sleeve thread 223, the flange 241 will abut the third sleeve support section 234. The sleeve thread 223 will extend outwardly past the end of the sleeve nut 216 when the sleeve nut is threaded onto the sleeve thread 223. As the sleeve nut 216 is further threaded onto the sleeve thread 223, the barrel tube 212 will become fully tensioned. That is, as the sleeve nut 216 is threaded in place in a manner so that the barrel tube 212 will become fully tensioned, thereby producing a concentric arrangement of the barrel 212 and the outer sleeve 214.

Figure 30:
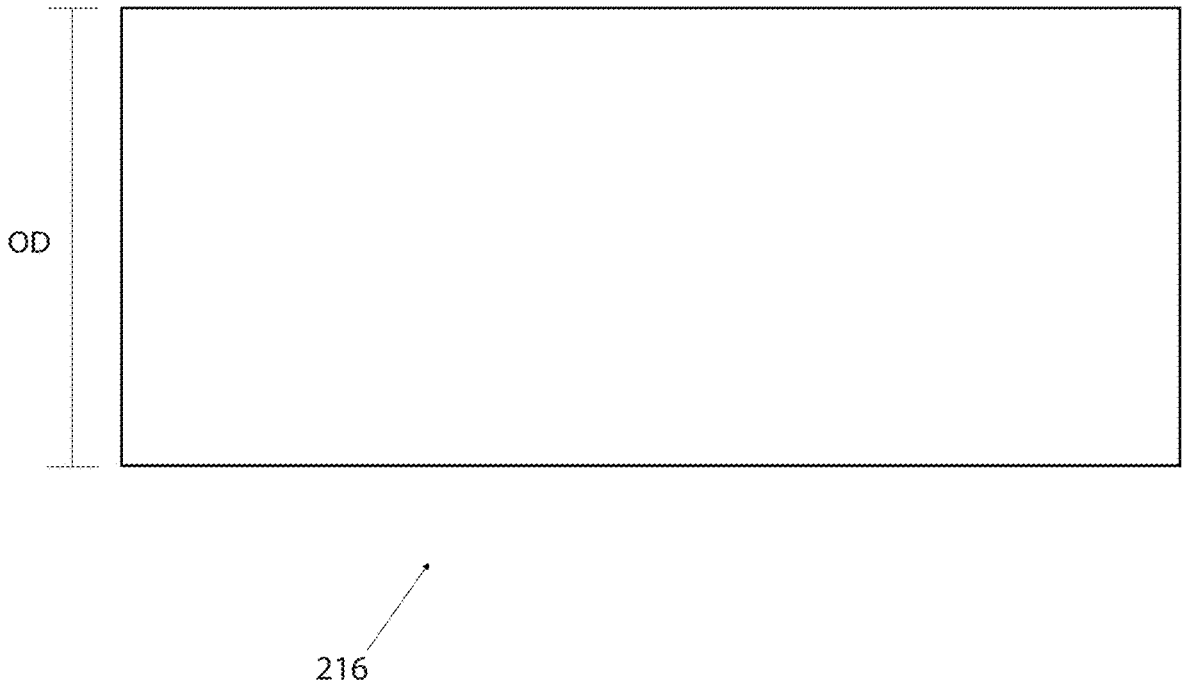
FIG. 30 is a side planar view of the sleeve nut shown in FIG. 29.

FIG. 30 is a side planar view of the sleeve nut 216. As shown, the sleeve nut 216 has a consistent outer diameter, which is the same as the diameter of the outer sleeve sections 214*a* and 214*b*, as well as the bushing 215 (see FIG. 25).

Figure 31:
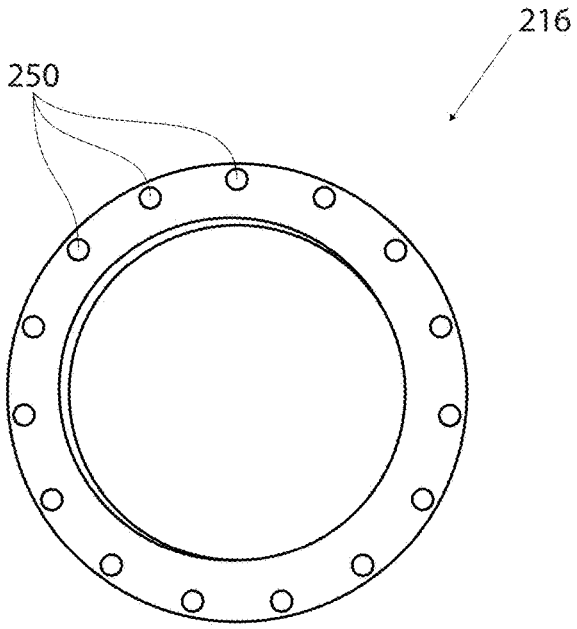
FIG. 31 is a front view of the sleeve nut shown in FIG. 29.

FIG. 31 us a front view of the sleeve nut 216. A plurality of pin holes 250 are circumferentially located on the front end of the sleeve nut 216. The pinholes 250 allow for the insertion of a wrench, if needed. It should be understood that use of the term sleeve nut and muzzle keeper are used interchangeably for the present invention and refer to the same element of the firearm barrel 210.

Figure 32:
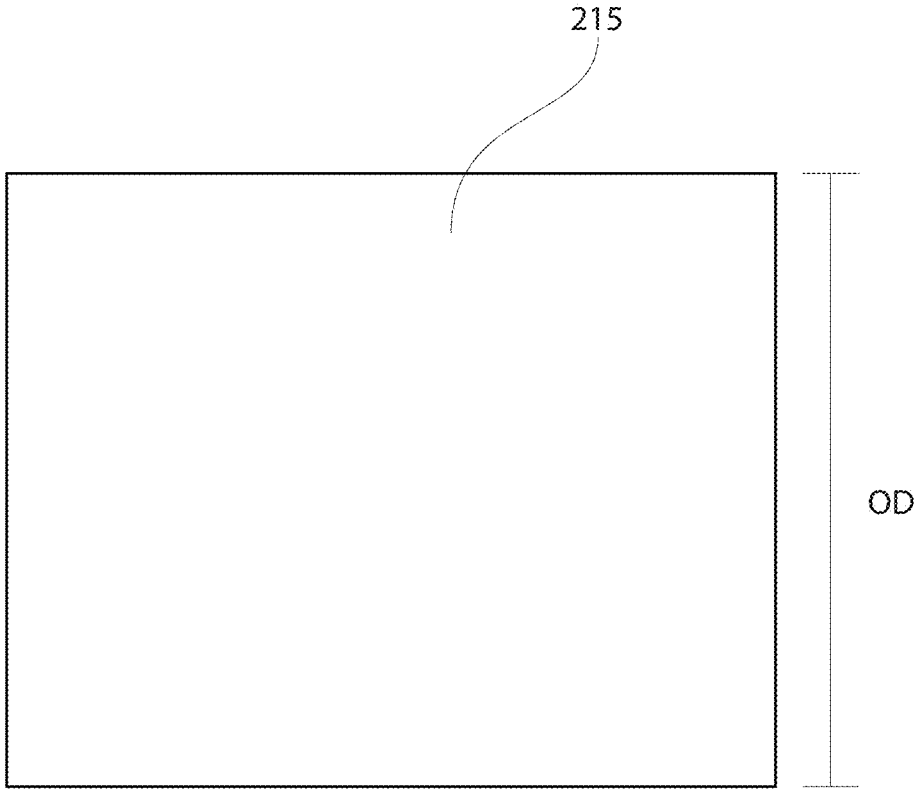
FIG. 32 is a side view of a bushing used in the embodiment shown in FIG. 25.
Figure 33:
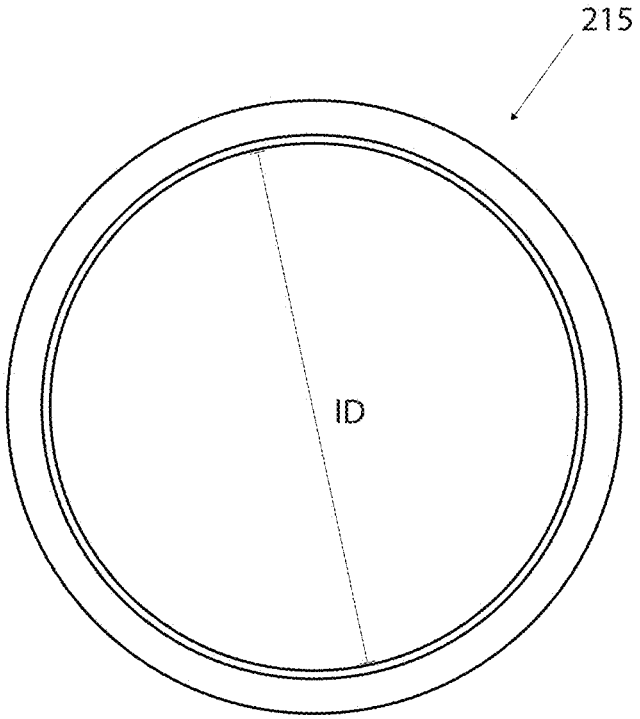
FIG. 33 is a front view of the bushing shown in FIG. 32.

FIGS. 32 and 33 depict the bushing 215. The bushing 215 has an OD the same as that of the outer sleeve 214 and has an inner diameter (ID) that allows it to be fittingly seated on the second sleeve support section 232 (see FIG. 27).

Figure 34:
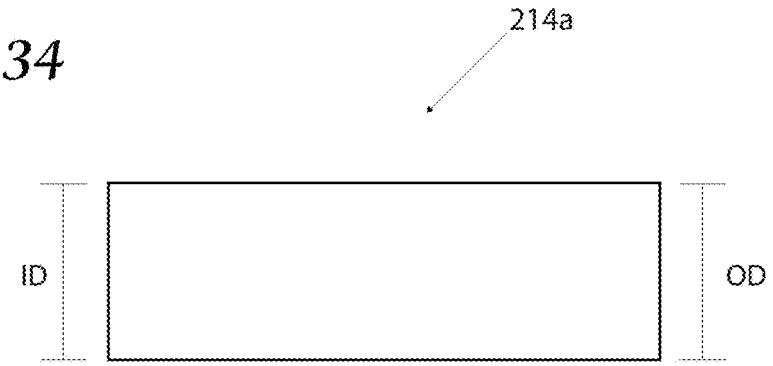
FIG. 34 is a side view of an outer sleeve used in the embodiment shown in FIG. 25.
Figure 35:
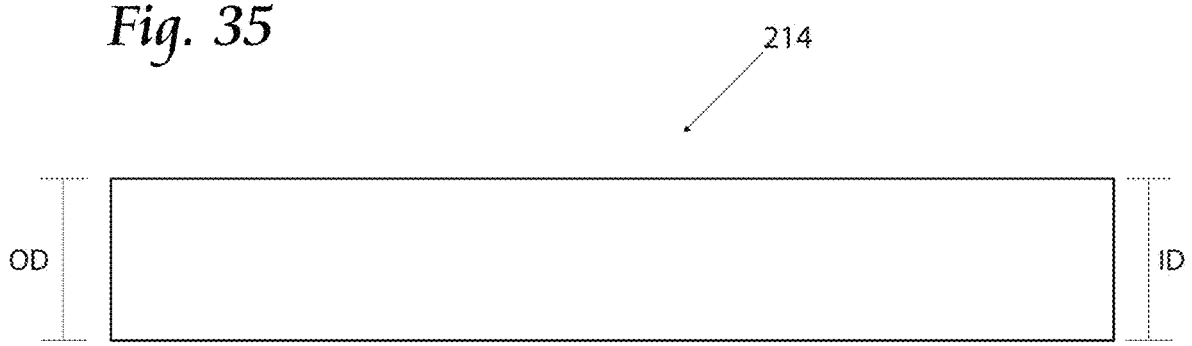
FIG. 35 is a side view of a second outer sleeve used in the embodiment shown in FIG. 25.

As with the bushing, the front sleeve section 214*a* as shown in FIG. 34 has a constant OD and a constant ID. The OD is the same as that of the bushing 215, while the ID allows for the sleeve section to be fittingly seated on the second sleeve support 232 and the third sleeve support 234. The rear sleeve section 214*b* shown in FIG. 35 has the same OD and ID as discussed above with respect to the bushing 215 and the front sleeve section 214*a*.

The assembled firearm barrel 210 as described allows for a securely and fully tensioned firearm barrel, as described and understood with the previously described embodiments.

FIGS. 36-42 provide another alternate firearm barrel 310 according to the present invention. The firearm barrel 310 is comprised of the same main features as the other firearm barrels according to the present invention: an inner barrel; and outer sleeve; an air gap located between the inner barrel and the outer sleeve; and a sleeve nut or muzzle keeper that will be threaded onto the inner barrel to fully tension and retain the outer sleeve securely on the inner barrel.

Figure 36:
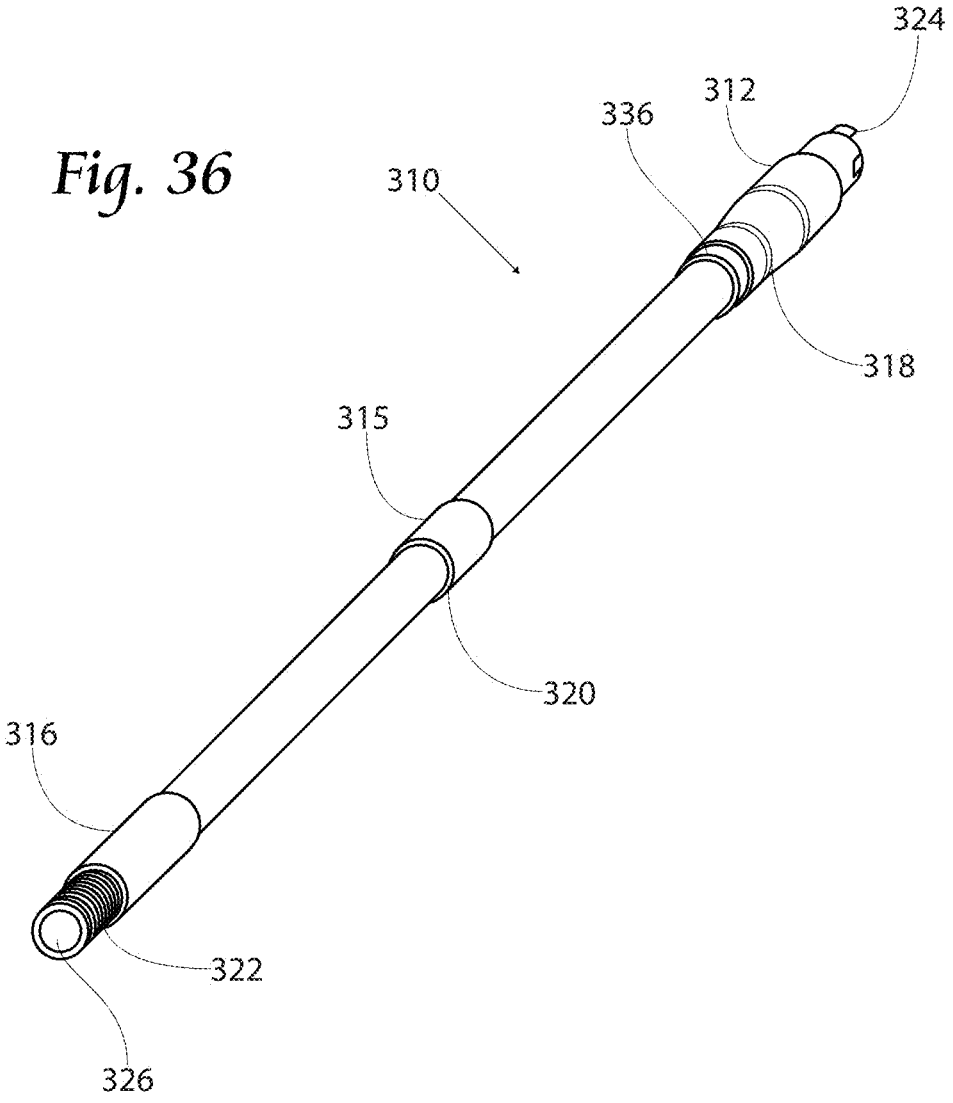
FIG. 36 is a perspective view of an alternate inner barrel according to the present invention.

FIG. 36 depicts a perspective view of the inner barrel 312 of the firearm barrel 310. The inner barrel 312 is shown without an outer sleeve, but supporting a bushing 315 and a sleeve nut 316. As will be appreciated in the following drawings, the bushing 315 and the sleeve nut 316 are threaded onto the inner barrel 312.

Still referring to FIG. 36, the inner barrel 312 has a rear section 318, an intermediate section 320, and a front section 322. The rear section 318 has an entrance end 324 and the front section 322 has an exit end 326. The rear section 318 includes a support area 336 that will support an outer sleeve (see FIG. 38), as in the previous arrangements and embodiments.

Figure 37:
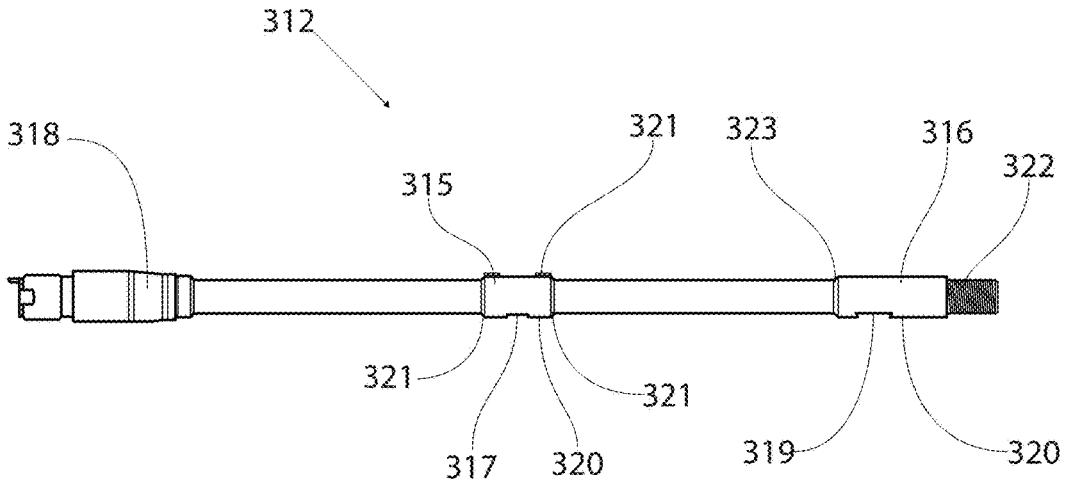
FIG. 37 is a side planar view of the inner barrel shown in FIG. 36.

The inner barrel 312 is further depicted in FIG. 37 supporting the bushing 315 and the sleeve nut 316. The bushing 315 and the sleeve nut 316 each have a dovetail, noted as 317 and 319, respectively. The intermediate section 320 provides for a support surface 321 that supports the bushing 315 and also extends forward and back for eventual support of an outer sleeve or outer sleeves (see FIG. 38). Similarly, the front section 322 also has a support surface 323 for support of an outer sleeve, as well.

Figure 38:
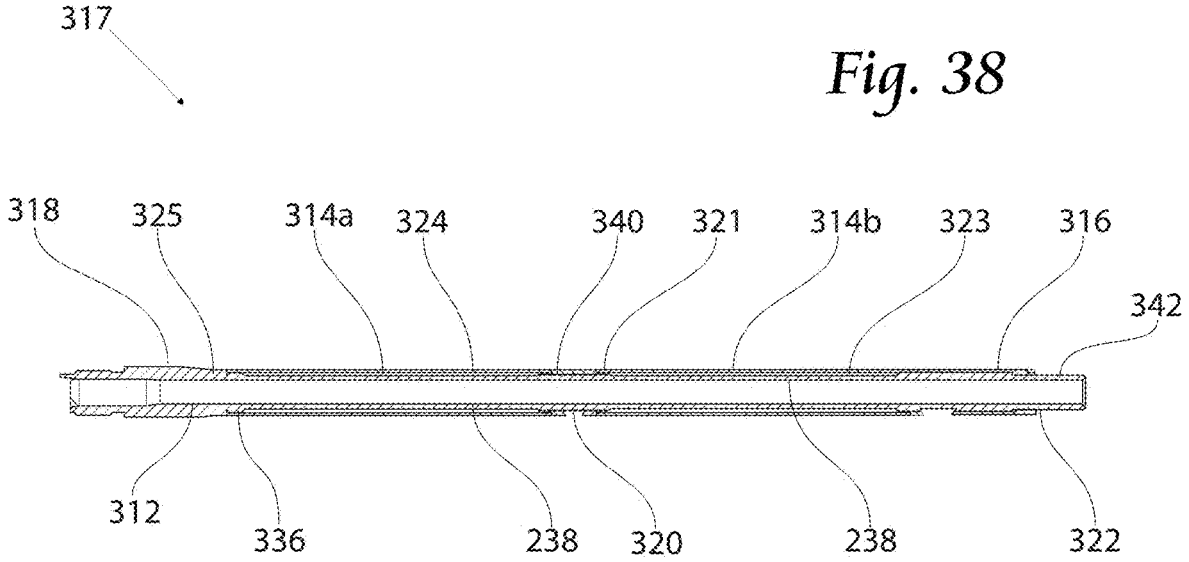
FIG. 38 is a cross-sectional view of an alternate firearm barrel according to the present invention.

FIG. 38 provides a cross-sectional view of the firearm barrel 310. The inner barrel 312 supports a first outer sleeve 314*a* and a second outer sleeve 314*b*. The first outer sleeve 314*a* extends from the support area 336 to the rear of the support area 321. The second outer sleeve 114*b* extends from the front of the support area 321 to the support surface 323. The first outer sleeve 314*a* abuts the rear section 318. A slight open area 325 may be formed between the support area 336, the rear section 318, and the outer sleeve 314*b*. The arrangement allows for an air gap 324 between the outer sleeves 314*a* and 314*b* the inner barrel 312.

As mentioned previously, the intermediate section 320 has a threaded surface 340 that will receive the bushing 315. The front section 322 also has a threaded surface 342 for receiving the sleeve nut 316. The threaded surfaces 340 and 342 aid in the full tensioning of the firearm barrel 310, as discussed with the previous embodiments.

Figure 39:
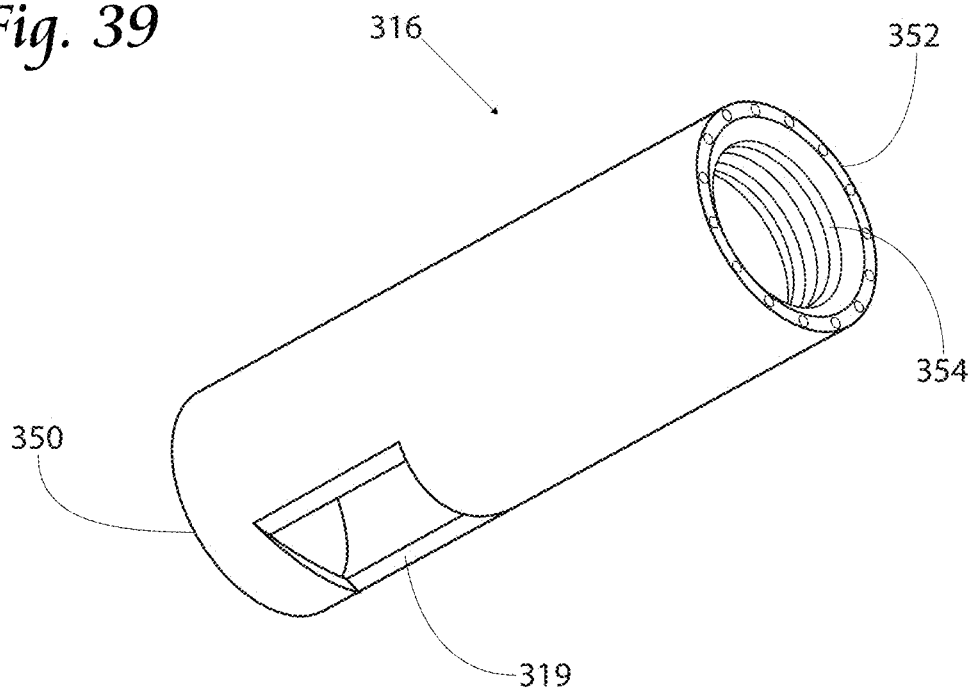
FIG. 39 is a perspective view of a muzzle keeper or sleeve nut used with the firearm barrel shown in FIG. 38.
Figure 40:
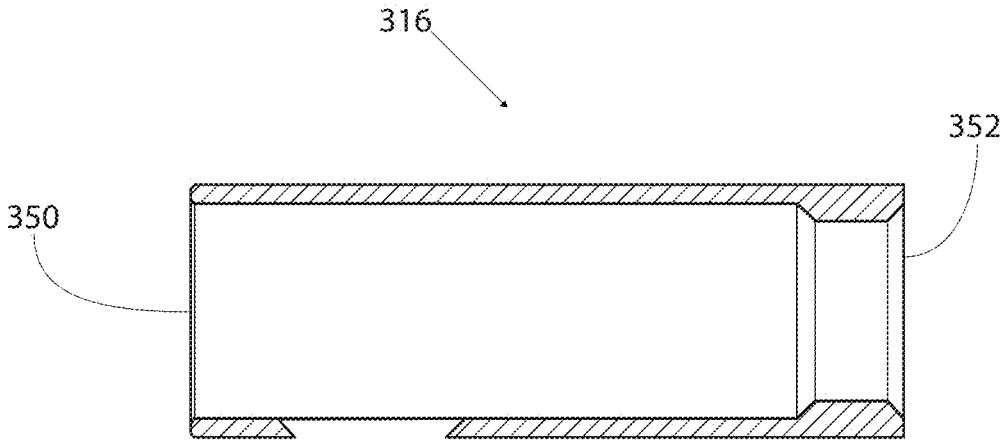
FIG. 40 is a cross-sectional view of a muzzle keeper shown in FIG. 39.

FIGS. 39 and 40 depict the sleeve nut 316 used with the firearm barrel 310. The sleeve nut 316 has a first end 350 and a second end 352 and includes the dovetail 319. The sleeve nut 316 has an internal threaded portion 354, which allows the sleeve nut 316 to be threaded onto the inner barrel 312 (see FIG. 38). As with the other embodiments of the present invention, the sleeve nut 316 will be threaded past the end of the inner barrel 312 to fully tension the firearm barrel 310.

Figure 41:
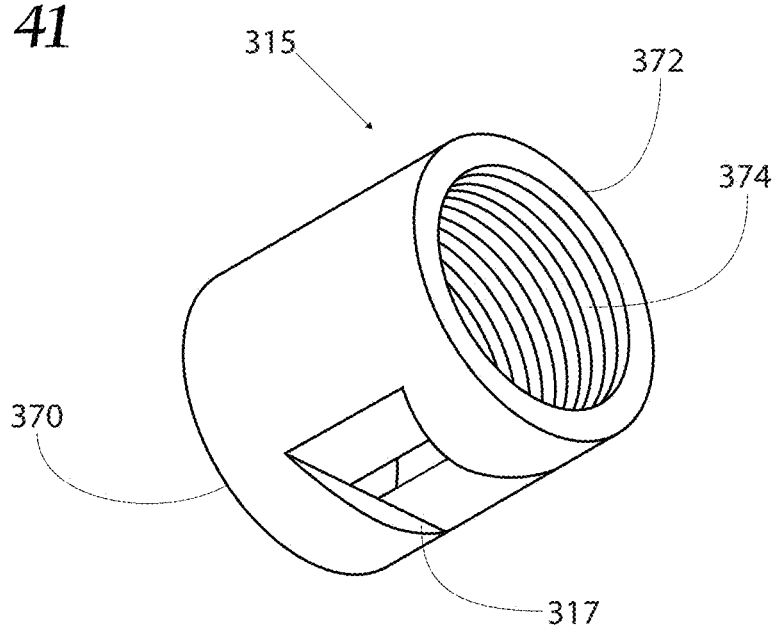
FIG. 41 is a perspective view of a bushing used with firearm barrel shown in FIG. 36.
Figure 42:
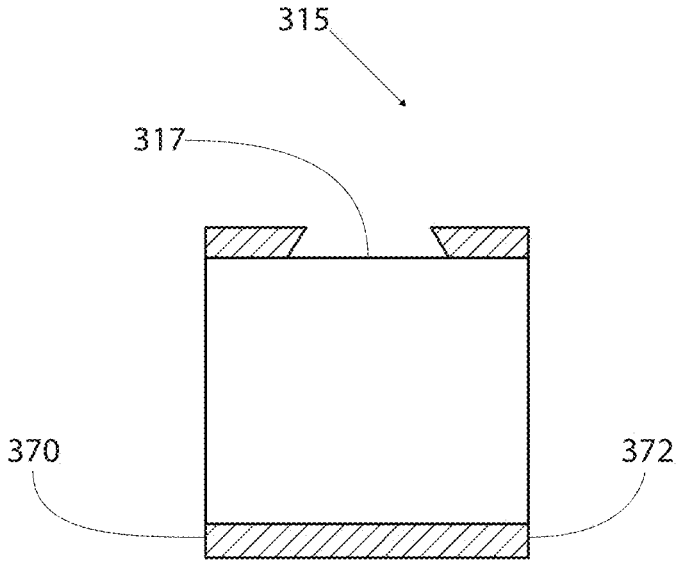
FIG. 42 is a cross-sectional view of the bushing shown in FIG. 41.

FIGS. 41 and 42 depict the bushing 315 which has a first end 370 and a second end 372 and includes the dovetail 317. The bushing 315 has a threaded surface 374 that will allow the bushing 315 to be threaded onto the intermediate section 320 (see FIG. 38), as discussed previously.

FIGS. 43-55 provide a further firearm barrel 410 according to the present invention. Similar to the firearm barrel 310, firearm barrel 410 allows for threaded sections to be utilized while still providing for a firearm barrel having an outer sleeve that can be fully tensioned when situated on an inner barrel. An air gap is also maintained as with previous embodiments.

Figure 43:
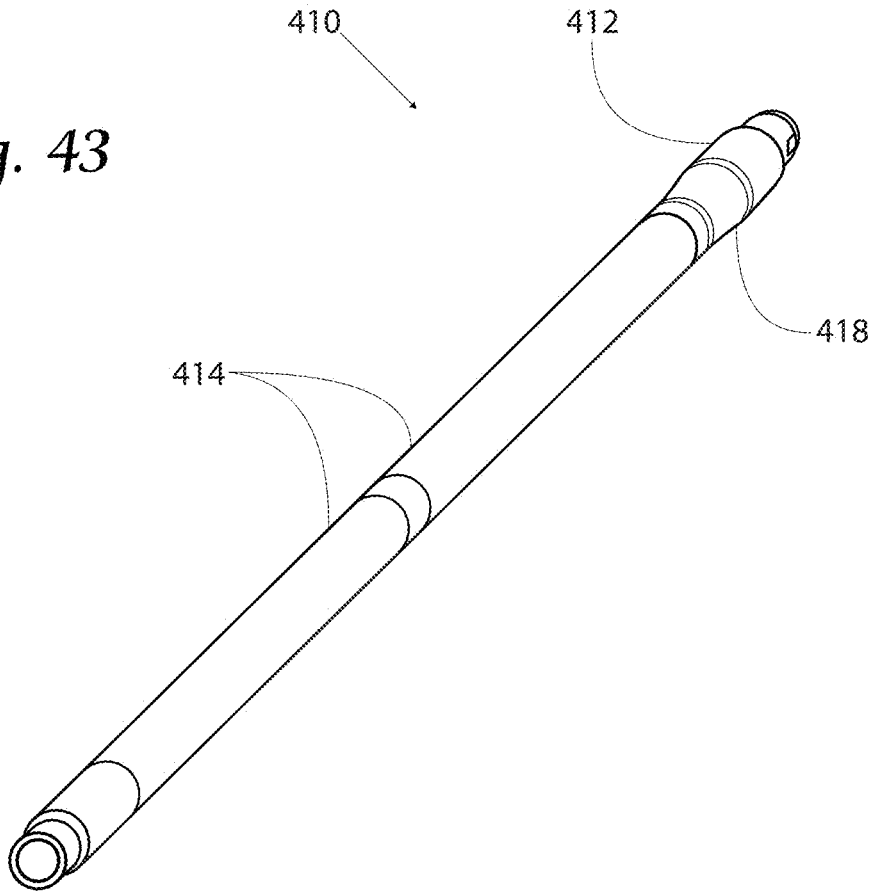
FIG. 43 is another arrangement of a firearm barrel according to the present invention.
Figure 44:
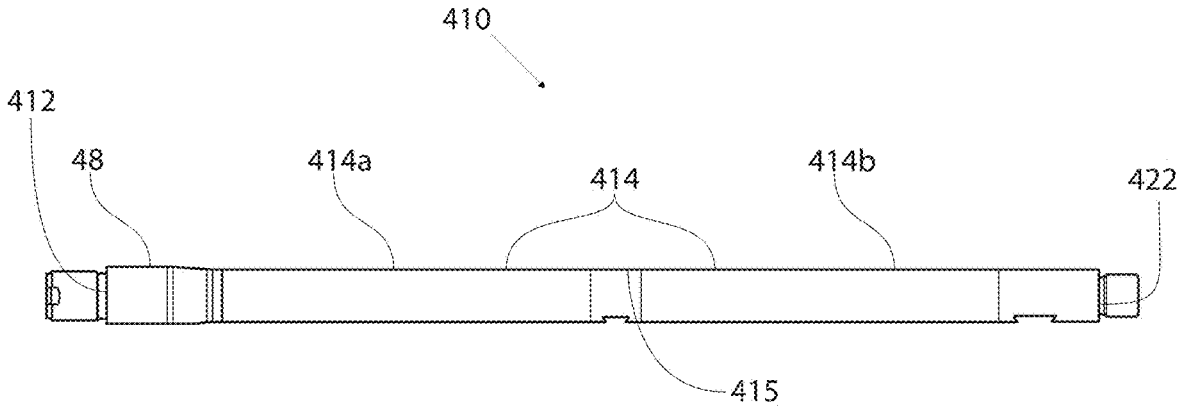
FIG. 44 is a side planar view of the firearm barrel shown in FIG. 43.
Figure 45:
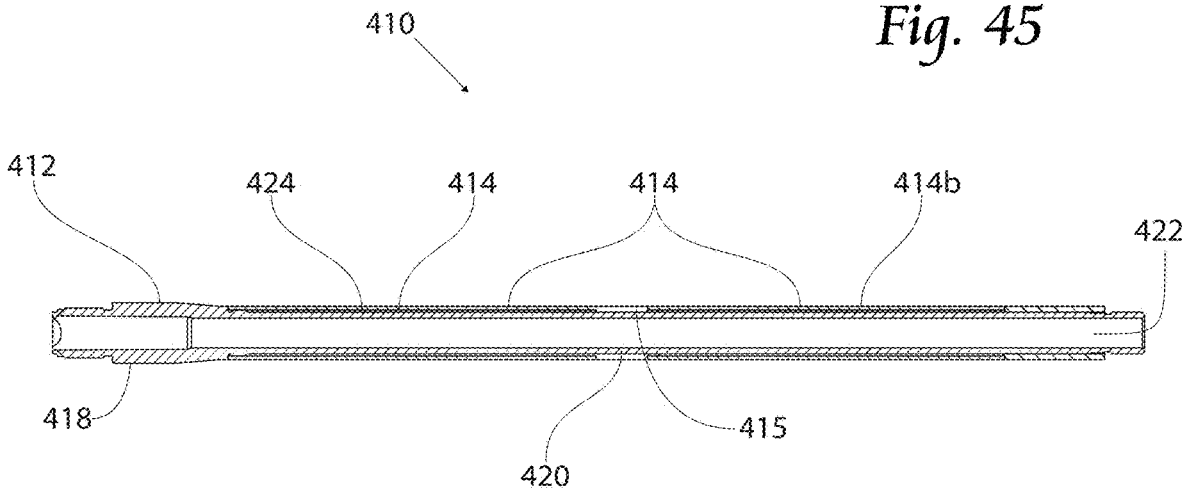
FIG. 45 is a cross-sectional view of the firearm barrel shown in FIG. 43.

Referring particularly to FIGS. 43-45 show the firearm barrel 410 having an inner barrel 412 and an outer sleeve 414. The inner barrel 412 has a rear section 418, and intermediate section 420 and a front section 422. The outer sleeve 414 comprises a first section 414*a* and a second section 414*b*. The first section 414*a* extends from rear section 418 to the intermediate section 420, while the second section 414*b* extends from the intermediate section 420 to the front section 422. The sections 414*a*, 414*b* are supported as with previous arrangements and embodiments. Likewise, an air gap 424 is formed as discussed with previous embodiments.

Referring now to FIGS. 46-49, a sleeve nut or muzzle keeper 416 is depicted. The sleeve nut 416 is situated on the front section 422 and is threaded on the front section 422 to securely hold the outer sleeve 414 onto the inner barrel 412. The result is a fully tensioned barrel 410, as described and discussed previously with the various other embodiments.

The sleeve nut 416 has a first end 450 and a second end 452. A dovetail 454 is also located on the sleeve nut 416, as with previous embodiments. The first end 450 forms a support surface 456 that will support the second section 414*b* when the barrel 410 is assembled. The second section 414*b* will rest on the support surface 456 and abut an edge 458, with the arrangement contributing to the fully tensioning of the barrel 410 when fully assembled.

The second end 452 has an internally threaded portion 460 that allows for the sleeve nut 416 to be threaded onto the inner barrel 412 to contribute to the fully tensioning of the barrel 410. The threaded portion 460 extends sufficiently inwardly of the sleeve nut 416 so that the sleeve nut 416 is fully threaded onto the barrel 412, similarly as discussed with previous embodiments.

FIGS. 51-55 depict a bushing 415 used with the firearm barrel 410. The bushing 415 has a first end 470 and a second end 472 and a dovetail 474 located on the body of the bushing 415. The first end 470 forms a landing area 476 that will support the first section 414*a* when the barrel 410 is assembled. The landing area 476 end at a flange 478 that will provide an area for the front section 414*a* to rest against. In a similar arrangement, the second end 472 forms a second landing area 480 that will support the second section 414*b* when the barrel 410 is assembled. The second landing area 480 ends in a second flange 482 that will provide an area for the second section 414*b* to rest against.

Referring particularly to FIG. 55, the bushing 415 has an internally threaded surface 483 that will allow the bushing 415 to be threaded onto the intermediate section 420 of the inner barrel 412 (see FIG. 45). Thus, the firearm barrel 410 allows for both the bushing 415 and the sleeve nut 416 to be threaded onto the inner barrel 412 to provide for a fully tensioned firearm barrel 410.

As demonstrated in the various embodiments shown above, the lever action firearm barrel of the present invention provides a fully tensioned firearm barrel not shown or appreciated in the prior art. While each of the embodiments may differ from each other, the embodiments have novel features that are common in all embodiments. Each embodiment has an inner barrel, and outer barrel situated on the outer barrel, and a gap formed between the inner and outer barrel. Once properly positioned, a sleeve nut is threaded onto the inner barrel, with the sleeve nut being overly threaded onto the inner sleeve, thereby fully tensioning the firearm barrel.

The threaded arrangement of the present invention allows fully tensioning of the firearm barrel that was not realized or utilized in prior art arrangements. Whereas prior art arrangements provided a firearm barrel wherein a sleeve nut abutted the firearm barrel to hold it in place, the present invention allows for the sleeve nut to be threaded past the end of the firearm barrel, providing the fully tensioned firearm not found in the prior art.

It should be understood that the present invention allows for more than one threaded area or section to be incorporated into the firearm as shown, above. For example, the central bushing may be threaded, or other portions along the firearm barrel may be threaded, as well.

The present invention also includes the methods of forming a firearm barrel that provides a fully tensioned barrel. An inner barrel is provided that has an entrance end and an exit end, with a threaded portion located on the inner barrel near the exit end. An outer barrel is provided, with the outer barrel put in position around the inner barrel. A gap will be formed between the inner barrel and the outer barrel. A threaded sleeve nut having a threaded portion will be threaded onto the inner barrel, with the threaded portion being threaded past the end of the exit end. The threaded sleeve nut will be continuously threaded to fully tension the firearm barrel. The gap will be maintained, with the inner and outer barrels being concentrically arranged with one another. The methods of the present invention may also include positioning a bushing and one or more outer barrels around the inner barrel. The bushing may be threaded onto the inner barrel, if desired.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

The invention claimed is:

1. A firearm barrel for a lever action firearm, the firearm barrel comprising:

an inner barrel tube having an outer barrel surface, an inner barrel surface, an entrance end and an exit end, a sleeve thread formed on said exit end, and a raised sleeve support formed on an end opposite said exit end, said inner barrel tube including a rear section configured for attachment relative to a forearm of a lever action firearm and an intermediate section extending forwardly from said rear section toward said exit end;

an outer sleeve situated over the inner barrel tube, including an inner surface, said inner surface having an inner perimeter which is greater than an outer perimeter of said raised sleeve support, said outer sleeve being positioned on said intermediate section forward of said rear section and being spaced from said rear section to provide forearm clearance and magazine tube clearance for the lever action firearm;

an air gap formed between said inner barrel tube and said outer sleeve; and a sleeve nut including a sleeve end, a sleeve inner thread formed through said sleeve nut, said sleeve end in contact with said inner surface of said outer sleeve, wherein said inner barrel tube is inserted through said outer sleeve, wherein said sleeve nut is threaded on to said sleeve thread to retain said outer sleeve, wherein tightening said sleeve nut increases tension on a length of said barrel tube and tensions said firearm barrel, and wherein said air gap is maintained along said intermediate section while said outer sleeve remains clear of a forearm region and a magazine tube region of the lever action firearm.

2. The firearm barrel according to claim 1 wherein said outer sleeve comprises a non-metal material.

3. The firearm barrel according to claim 2, wherein the non-metal material comprises carbon fiber.

4. A firearm barrel for a lever action firearm, the firearm barrel comprising:

an inner barrel tube including an entrance end and an exit end, the exit end of said barrel tube includes a sleeve thread;

a raised sleeve support formed on said inner barrel on an end opposite said exit end;

a raised spacer section positioned on said inner barrel between said entrance end and said exit end of said inner barrel, said raised spacer section having a threaded portion;

a sleeve nut threaded on said exit end of said barrel tube, said sleeve nut threaded past an end of said sleeve thread;

a first outer sleeve supported by said raised sleeve support and said raised spacer section;

a second outer sleeve supported by said raised spacer section and said exit end;

an air gap formed between said inner barrel and said first and said second outer sleeves; wherein said threaded sleeve nut compresses said first and said second outer sleeves and tensions said inner barrel tube.

5. The firearm barrel according to claim 4 further comprising a bushing located on said raised spacer section.

6. The firearm barrel according to claim 5 wherein said bushing is a gas bushing.

7. The firearm barrel according to claim 4 wherein said first and said second outer sleeve comprises a non-metal material.

8. The firearm barrel according to claim 7, wherein said first and said second outer sleeve comprises a carbon fiber material.

9. The firearm barrel according to claim 4, further comprising a bushing, said bushing having a threaded surface for being threaded onto said thread portion of said raised spacer section.

10. A method of assembling a firearm barrel comprising:

providing an inner barrel tube including an entrance end having a sleeve support section and an exit end, the exit end of said barrel tube including a threaded sleeve section;

providing an outer sleeve having a first end and a second end;

positioning said outer sleeve around said inner barrel tube in manner that said first end is supported by said sleeve support section, thereby forming an air gap between said inner barrel tube and said outer sleeve;

providing a sleeve nut;

threading said sleeve nut onto said threaded sleeve section of said inner barrel tube; and continuing to thread sleeve nut onto said inner barrel tube section so that threaded sleeve section extends outwardly passed sleeve nut thereby tensioning said firearm barrel, wherein the method is carried out for a lever action firearm and said outer sleeve is positioned on an intermediate barrel region so as to maintain clearance for a forearm region and a magazine tube region of the lever action firearm while maintaining said air gap.

11. The method according to claim 10, wherein said inner barrel tube comprises a raised spacer section located between said entrance end and said exit end.

12. The method according to claim 11 further comprising the step of providing a second outer sleeve.

13. The method according to claim 12 further comprising the step of positioning said second outer sleeve around said inner barrel tube.

14. The method according to claim 13 further comprising the step of providing a bushing.

15. The method of claim 14 wherein said bushing is positioned on said raised spacer section.

16. A method of assembling a firearm barrel comprising:

providing an inner barrel tube including an entrance end having a sleeve support section and an exit end, the exit end of said barrel tube including a threaded sleeve section;

providing an outer sleeve having a first end and a second end;

positioning said outer sleeve around said inner barrel tube in manner that said first end is supported by said sleeve support section, thereby forming an air gap between said inner barrel tube and said outer sleeve;

providing a sleeve nut;

threading said sleeve nut onto said threaded sleeve section of said inner barrel tube;

continuing to thread sleeve nut onto said inner barrel tube section so that threaded sleeve section extends outwardly passed sleeve nut thereby tensioning said firearm barrel, wherein said inner barrel tube comprises a raised space spacer section located between said entrance end and said exit end, providing a second outer sleeve around said inner barrel tube, providing a bushing; and wherein said raised spacer section has a threaded surface and said bushing has a corresponding threaded surface, the method further comprising the step of threading said bushing onto said threaded surface of said raised spacer section.

* * * * *